US010584583B2

(12) United States Patent
Gisolf et al.

(10) Patent No.: US 10,584,583 B2
(45) Date of Patent: Mar. 10, 2020

(54) SYSTEM AND METHODS FOR PRETESTS FOR DOWNHOLE FLUIDS

(71) Applicant: Schlumberger Technology Corporation, Sugar Land, TX (US)

(72) Inventors: Adriaan Gisolf, Aberdeen (GB); Tudor Ioan Palaghita, Houston, TX (US); Stephen Dennis Parks, Houston, TX (US); Ashers Partouche, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 71 days.

(21) Appl. No.: 15/637,345

(22) Filed: Jun. 29, 2017

(65) Prior Publication Data

US 2018/0003049 A1 Jan. 4, 2018

Related U.S. Application Data

(60) Provisional application No. 62/357,133, filed on Jun. 30, 2016, provisional application No. 62/419,104, filed on Nov. 8, 2016.

(51) Int. Cl.

| | |
|---|---|
| ***E21B 34/06*** | (2006.01) |
| ***E21B 49/00*** | (2006.01) |
| ***E21B 49/10*** | (2006.01) |
| *E21B 49/08* | (2006.01) |

(52) U.S. Cl.

CPC ..... *E21B 49/10* (2013.01); *E21B 34/06* (2013.01); *E21B 49/00* (2013.01); *E21B 2049/085* (2013.01)

(58) Field of Classification Search

CPC ..... E21B 49/10; E21B 49/00; E21B 34/06; E21B 2049/085

See application file for complete search history.

(56) References Cited

U.S. PATENT DOCUMENTS

| | | | |
|---|---|---|---|
| 7,013,723 | B2 | 3/2006 | Ramakrishnan et al. |
| 7,178,392 | B2 | 2/2007 | Dhruva et al. |
| 7,178,591 | B2 | 2/2007 | Del Campo et al. |
| 7,277,796 | B2 | 10/2007 | Kuchuk et al. |
| 7,278,480 | B2 | 10/2007 | Longfield et al. |
| 7,546,885 | B2 | 6/2009 | Longfield |

(Continued)

*Primary Examiner* — David J Bagnell
*Assistant Examiner* — Yanick A Akaragwe
(74) *Attorney, Agent, or Firm* — Trevor G. Grove

(57) ABSTRACT

A method including positioning a downhole acquisition tool in a wellbore in a geological formation; performing a pretest sequence to gather at least one of pressure or mobility information based on downhole acquisition from a sample line, a guard line, or both while the downhole acquisition tool is within the wellbore. The pretest sequence includes controlling a valve assembly to a first valve configuration that may allow the fluid to flow into the downhole tool via one or more flowlines toward a pretest system. The one or more flowlines include the sample line only, the guard line only, or both the sample line and the guard line; and drawing in the fluid through the one or more flowlines. The method also includes controlling the valve assembly to a second valve configuration. The second valve configuration is different from the first valve configuration and may block the one or more flowlines from drawing in the fluid.

20 Claims, 28 Drawing Sheets

(56) References Cited

U.S. PATENT DOCUMENTS

| | | | | |
|---|---|---|---|---|
| 8,078,403 | B2 | 12/2011 | Zhang et al. | |
| 8,905,128 | B2 * | 12/2014 | Niconoff | E21B 49/10 166/250.01 |
| 9,115,544 | B2 | 8/2015 | Harms et al. | |
| 2006/0260805 | A1 | 11/2006 | Longfield | |
| 2015/0013973 | A1 * | 1/2015 | Murphy | E21B 49/10 166/250.15 |
| 2015/0068734 | A1 | 3/2015 | Smits | |
| 2015/0135814 | A1 | 5/2015 | Zuo et al. | |
| 2015/0354342 | A1 | 12/2015 | Betancourt et al. | |

* cited by examiner

SYSTEM AND METHODS FOR PRETESTS FOR DOWNHOLE FLUIDS

CROSS-REFERENCE TO RELATED APPLICATIONS

This applications is based on and claims the benefit of and priority to U.S. Provisional Application No. 62/357,133, entitled "System And Methods For Pretests For Downhole Fluids", filed on Jun. 30, 2016, and U.S. Provisional Application No. 62/419,104, entitled "System And Methods For Pretests For Downhole Fluids," filed on Nov. 8, 2016, the entire disclosures of which are hereby incorporated herein by reference.

BACKGROUND

This disclosure relates to efficiently performing pretests of downhole fluids.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Reservoir fluid analysis may be used in a wellbore in a geological formation to locate hydrocarbon-producing regions in the geological formation, as well as to manage production of the hydrocarbons in these regions. A downhole acquisition tool may carry out reservoir fluid analysis by drawing in formation fluid and testing the formation fluid downhole or collecting a sample of the formation fluid to bring to the surface. For example, the downhole acquisition tool may use a probe and/or packers to isolate a desired region of the wellbore (e.g., at a desired depth) and establish fluid communication with the subterranean formation surrounding the wellbore. The probe may draw the formation fluid into the downhole acquisition tool.

Before drawing in the formation fluid into the downhole acquisition tool, certain preliminary tests (pretests) may be performed. The pretests may be used to assess certain properties of the various downhole fluids, such as fluid mobility, which may in turn be used to more effectively operate the downhole acquisition tool and its supporting equipment during a subsequent fluid test. The pretests may be performed relatively often. In some cases, the pretests may be performed each time the downhole acquisition is moved to a new station at a different depth of the well. Therefore, depending on the number of stations and time of each pretest, the cumulative time delay due to performing numerous pretests may have a substantial impact on the total time involved in performing a fluid sampling or fluid testing operation on a well.

SUMMARY

This summary is provided to introduce a selection of concepts that are further described below in the detailed description. This summary is not intended to identify key or essential features of the subject matter described herein, nor is it intended to be used as an aid in limiting the scope of the subject matter described herein. Indeed, this disclosure may encompass a variety of aspects that may not be set forth below.

In one example, a method including positioning a downhole acquisition tool in a wellbore in a geological formation; performing a pretest sequence to gather at least one of pressure or mobility information based on downhole acquisition from a sample line, a guard line, or both while the downhole acquisition tool is within the wellbore. The pretest sequence includes controlling a valve assembly to a first valve configuration that may allow the fluid to flow into the downhole tool via one or more flowlines toward a pretest system. The one or more flowlines include the sample line only, the guard line only, or both the sample line and the guard line; and drawing in the fluid through the one or more flowlines. The method also includes controlling the valve assembly to a second valve configuration. The second valve configuration is different from the first valve configuration and may block the one or more flowlines from drawing in the fluid.

In another example, a system includes a downhole acquisition tool housing containing a pretest system that may collect at least one of pressure or mobility information from the fluid that enters the downhole acquisition tool from a sample line, a guard line, or both and a data processing system that may execute the pretest sequence by collecting fluid from the sample line only, the guard line only, or both the sample line and the guard line. The data processing system includes one or more tangible, non-transitory, machine-readable media having instructions to: performing a pretest sequence by: controlling a valve assembly to a first valve configuration that may allow the fluid to flow into the downhole tool via one or more flowlines toward a pretest system. The one or more flowlines includes the sample line only, the guard line only, or both the sample line and the guard line; and drawing in the fluid through the one or more flowlines. The data processing system also includes one or more tangible, non-transitory, machine-readable media having instructions to: performing a pretest sequence by controlling the valve assembly to a second valve configuration. The second valve configuration is different from the first valve configuration and may block the one or more flowlines from drawing in the fluid. This may be followed by further pretest sequences in other valve configurations.

In another example, one or more tangible, non-transitory, machine-readable media having instructions to: performing a pretest sequence by: controlling a valve assembly to a first valve configuration that may allows the fluid to flow into the downhole tool via one or more flowlines toward a pretest system. The one or more flowlines include the sample line only, the guard line only, or both the sample line and the guard line; and drawing in the fluid through the one or more flowlines. The one or more tangible, non-transitory, machine-readable medical also includes instructions to perform the pretest sequence by controlling the valve assembly to a second valve configuration. The second valve configuration is different from the first valve configuration and may block the one or more flowlines from drawing in the fluid.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which:

FIG. 25 illustrates a flowchart of a method for performing a non-sequenced sample line pretest using the wireline wellsite system of FIGS. 23 and 24, in accordance with an embodiment;

FIG. 26 illustrates a flowchart of a method of another example for performing a non-sequenced sample line pretest using the wireline wellsite system of FIGS. 23 and 24, in accordance with an embodiment;

Figure 23:
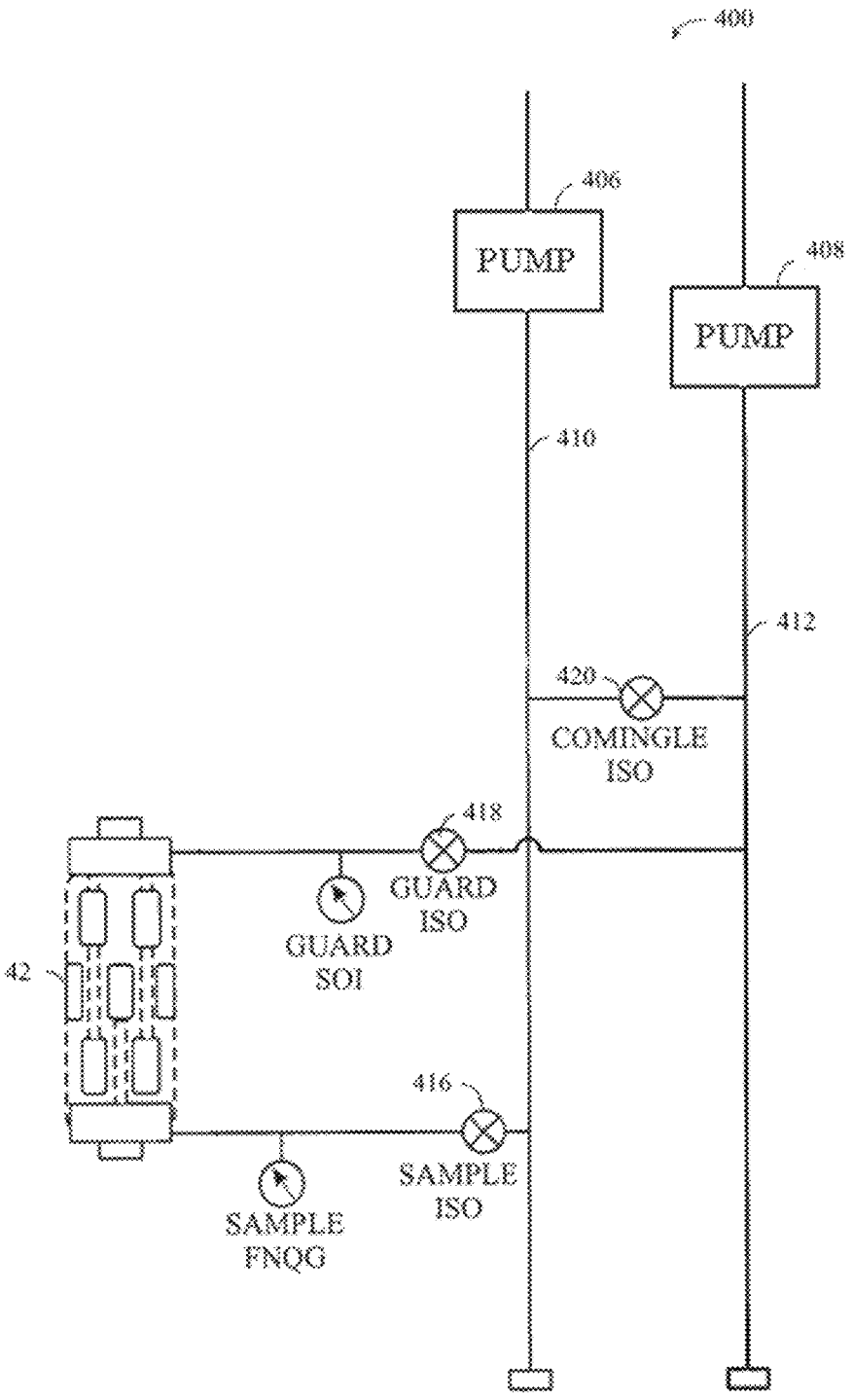
FIG. 23 is a schematic diagram representing another example of a wireline wellsite system that may be used to identify properties of the formation fluids in the wellbore, whereby the wireline wellsite system includes a dual flowline radial probe having a two pump modules, in accordance with an embodiment.
Figure 24:
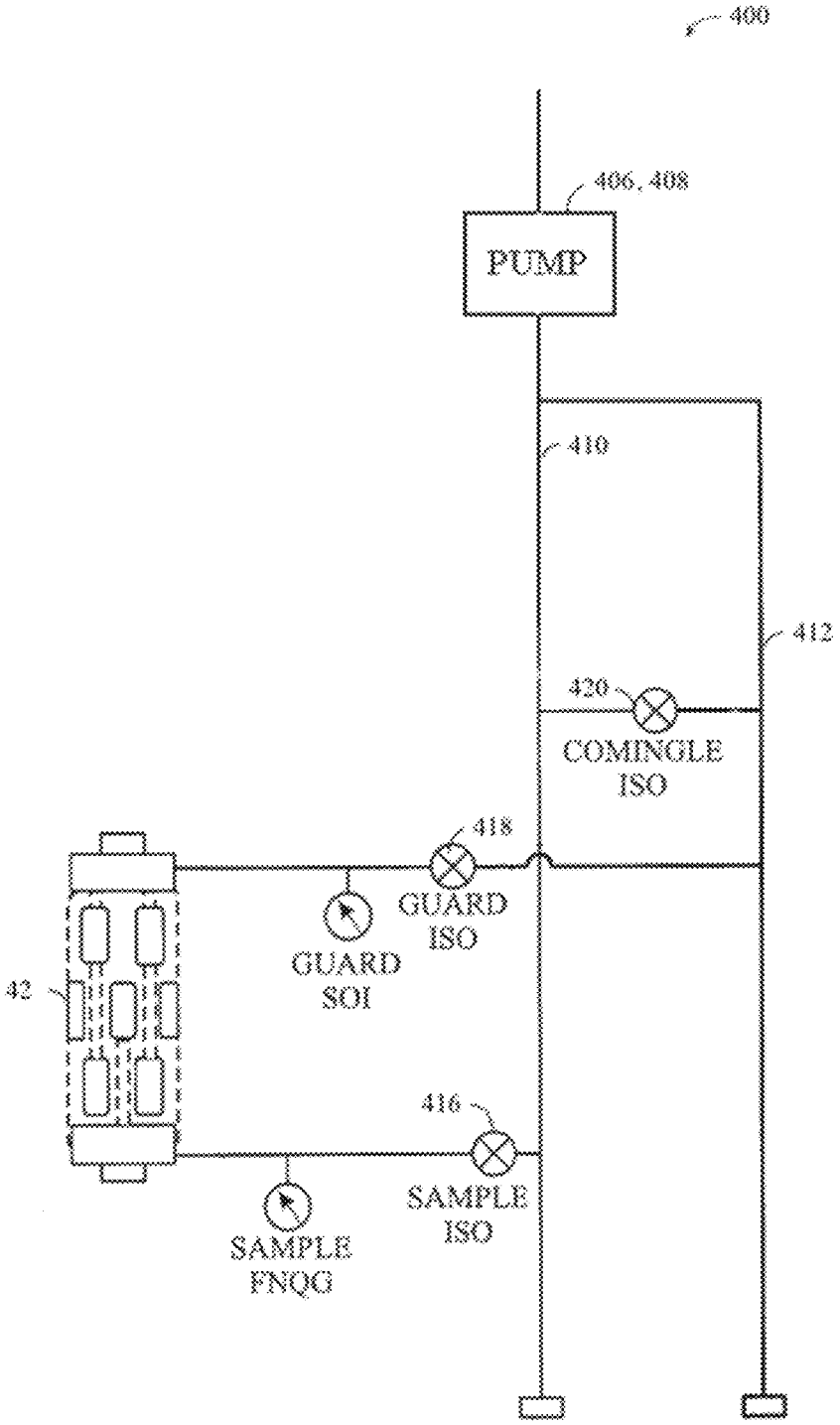
FIG. 24 is a schematic diagram representing another example of a wireline wellsite system that may be used to identify properties of the formation fluids in the wellbore, whereby the wireline wellsite system includes a dual flowline radial probe having a single pump module, in accordance with an embodiment.
Figure 36:
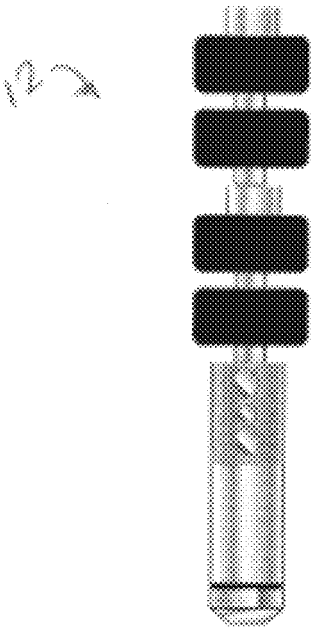
Figure 37:
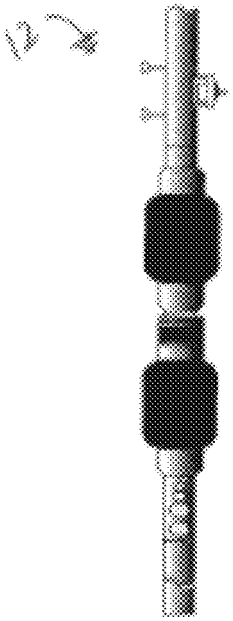
Figure 38:
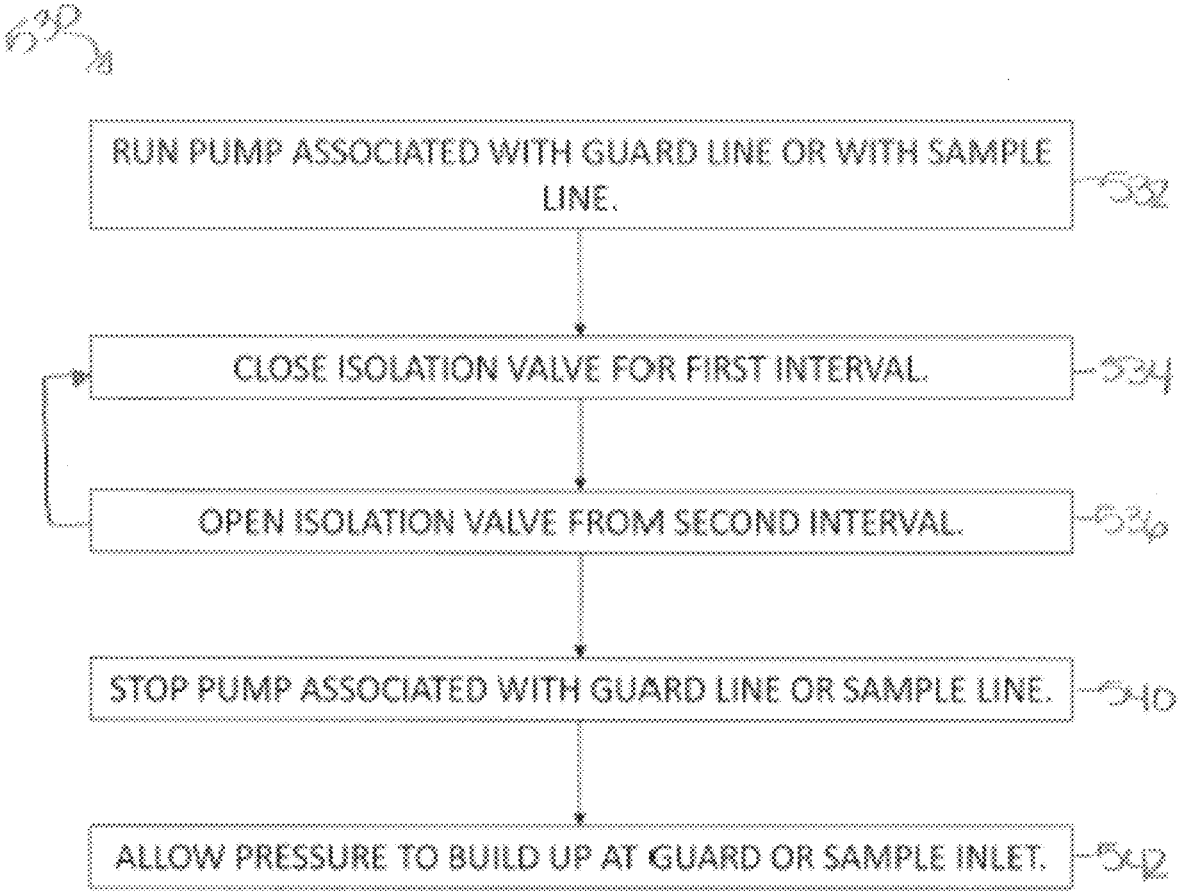

FIG. 36 illustrates a schematic diagram representing another example of the wireline wellsite system of FIGS. 23 and 24 having multiple inlets for use in a sequence pretest method, in accordance with an embodiment;

FIG. 37 illustrates a schematic diagram representing another example of the wireline wellsite system of FIGS. 23 and 24 having multiple inlets for use in a sequence pretest method, in accordance with an embodiment; and FIG. 38 illustrates a flowchart of a method of for performing a sequenced pretest using the wireline wellsite system of FIGS. 33-37, in accordance with an embodiment.

DETAILED DESCRIPTION

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

In accordance with the present disclosure, certain preliminary tests (pretests) may be used prior to drawing in a formation fluid into the downhole acquisition tool. The pretests may be used to assess the certain fluid properties, such as fluid mobility. According to an aspect of the disclosure, the fluid mobility information may be used to adjust operation of the downhole acquisition tool and the associated equipment. It may be appreciated that it may be highly valuable to ascertain the properties of the formation fluid (e.g., fluid mobility) to identify how fast to operate equipment associated with the downhole acquisition tool (e.g., pumps).

According to another aspect of the disclosure, methods and apparatus to perform a pretest are disclosed including drawing down the formation fluid in a downhole acquisition tool to gain formation property information (e.g., formation pressure, mobility, etc.). The formation property information may be estimated by the disclosed methods, which may include performing a pretest sequence including a first pretest (e.g., a guard line pretest) and a second-pretest (e.g., a sample line pretest). In an example method, a sample probe or other fluid communication device of a formation testing tool is used to contact a borehole wall. During the first pretest (e.g., a guard line pretest), a first valve configuration is controlled to enable fluid to flow into the downhole tool via one or more first flow lines toward a pretest system. During the second pretest (e.g., a sample line pretest), a second valve configuration is controlled to enable fluid to flow into the downhole tool via flow lines toward the pretest system. According to an aspect of the disclosure, the pretest sequence includes transitioning between the first pretest sequence and the second pretest sequence by using the probe architecture (e.g., a comingle valve) to enable the transition. The transition between the first pretest sequence and the second pretest sequence may save time associated with the pretest by enabling the drawing in of fluid associated with the second pretest from one or more second lines before the first pretest fluid has stabilized. In other words, instead of waiting for the first fluid drawn in by the first pretest to stabilize, the second fluid can be drawn in by the second pretest sooner. Thus, the time for pressure to build up in both sets of lines (e.g., the first flow lines and the second flow lines) is reduced by enabling the pressure buildup of the second flow lines to start earlier. As may be appreciated, the time for pressure to build up in the flow lines may range from a few seconds to several minutes. By allowing the pressure to build up in the first flow lines and the second flow lines simultaneously, the overall time of the pretest is reduced by eliminating the need to build up pressure in the first and second sets of flow lines separately.

During the drawdown of the fluids (e.g., through the guard line and the sample line), pressure data associated with the fluid is gathered and analyzed to determine for example, a pattern or trend of the data, a deviation from the trend or pattern, and/or comparison of fluid property data associated with the guard line and the sample line from the contacted formation. According to an aspect of the disclosure, the fluid information (e.g., pressure data) associated with the guard line and the sample line may be compared to help optimize the fluid sampling process. For example, comparing the fluid information from the guard line and the sample line may include a measure of rock heterogeneity. The measure of rock heterogeneity may provide useful insights that affect the operation of the downhole acquisition tool. For example, if the difference in rock heterogeneity between the guard line and the sample line is greater than expected, the flow rate of either the sample line or the guard line may be adjusted to reduce the pressure differential between the sample line and the guard line to reduce stress on the equipment (e.g., a packer).

Figure 1:
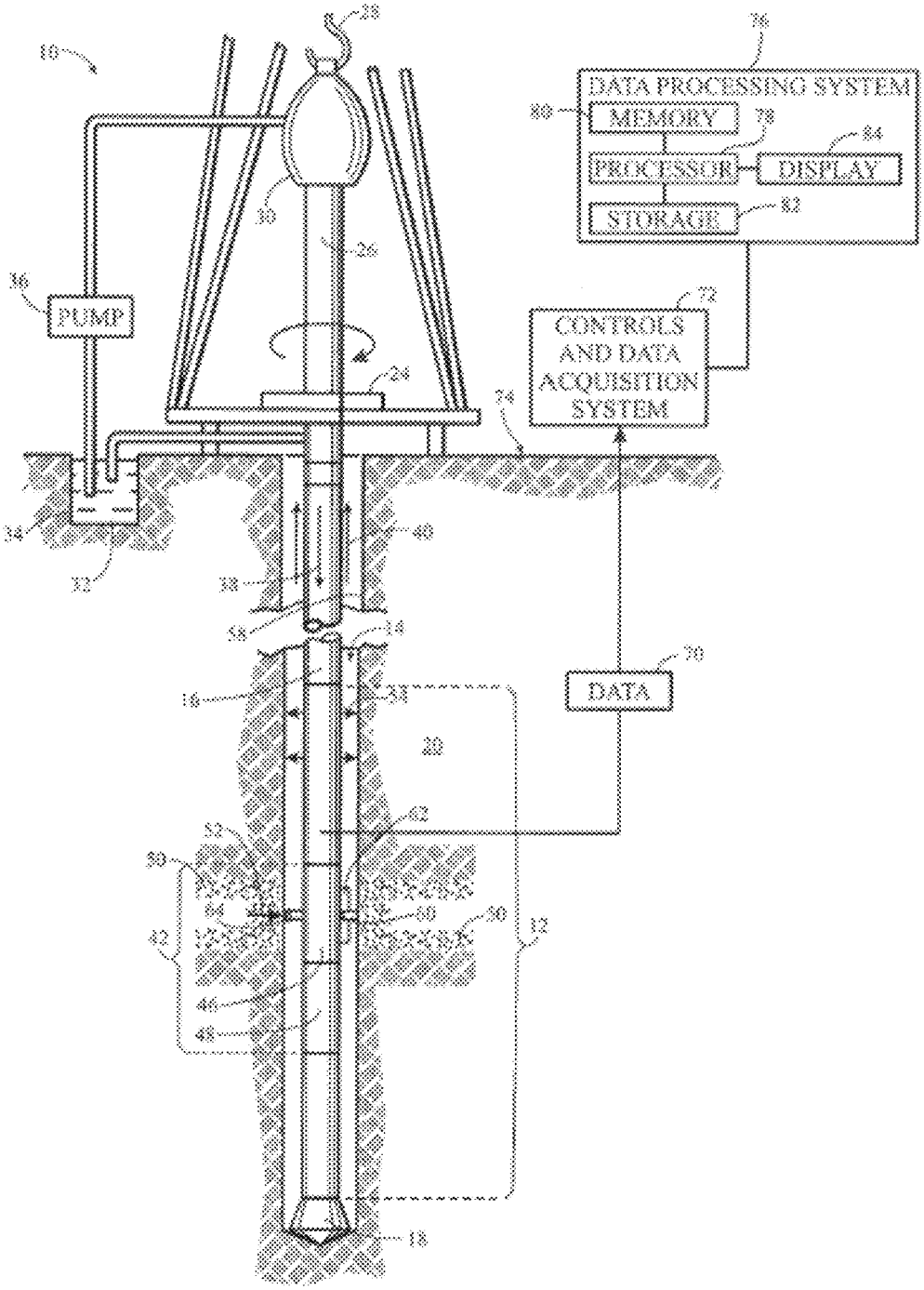
FIG. 1 is a schematic diagram of a logging-while-drilling wellsite system that may be used to identify properties of formation fluids in the wellbore, in accordance with an embodiment.
Figure 2:
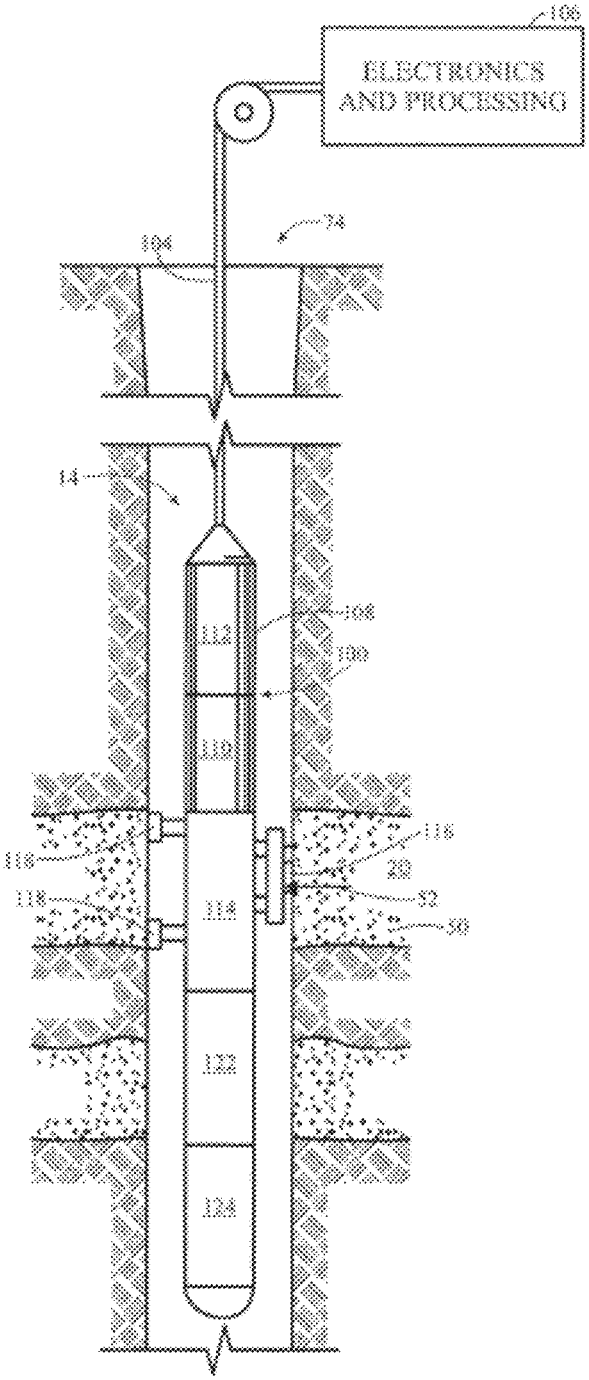
FIG. 2 is a schematic diagram of another example of a wireline wellsite system that may be used to identify properties of the formation fluids in the wellbore, in accordance with an embodiment.

FIGS. 1 and 2 depict examples of wellsite systems that may employ such fluid analysis systems and methods. In FIG. 1, a rig 10 suspends a downhole acquisition tool 12 into a wellbore 14 via a drill string 16. A drill bit 18 drills into a geological formation 20 to form the wellbore 14. The drill string 16 is rotated by a rotary table 24, which engages a kelly 26 at the upper end of the drill string 16. The drill string 16 is suspended from a hook 28, attached to a traveling block, through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Drilling fluid referred to as drilling mud 32, is stored in a pit 34 formed at the wellsite. A pump 36 delivers the drilling mud 32 to the interior of the drill string 16 via a port in the swivel 30, inducing the drilling mud 32 to flow downwardly through the drill string 16 as indicated by a directional arrow 38. The drilling mud 32 exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a component of a bottom hole assembly ("BHA"), may be positioned near the drill bit 18 and may include various components with capabilities such as measuring, processing, and storing information, as well as communicating with the surface. Additionally or alternatively, the downhole acquisition tool 12 may be conveyed on wired drill pipe, a combination of wired drill pipe and wireline, or other suitable types of conveyance.

The downhole acquisition tool 12 may further include a pretest system 42, which may include a fluid communication module 46, a sampling module 48, and a sample bottle module 49. In a logging-while-drilling (LWD) configuration, the modules may be housed in a drill collar for performing various formation evaluation functions, such as pressure testing and fluid sampling, among others, and collecting representative samples of native formation fluid 50. As shown in FIG. 1, the fluid communication module 46 is positioned adjacent the sampling module 48; however the position of the fluid communication module 46, as well as other modules, may vary in other embodiments. Additional devices, such as pumps, gauges, sensors, monitors or other devices usable in downhole sampling and/or testing also may be provided. The additional devices may be incorporated into modules 46 or 48 or disposed within separate modules.

The downhole acquisition tool 12 may evaluate fluid properties of an obtained fluid 52. Generally, when the obtained fluid 52 is initially taken in by the downhole acquisition tool 12, the obtained fluid 52 may include some drilling mud 32, some mud filtrate 54 on a wall 58 of the wellbore 14, and the native formation fluid 50. The downhole acquisition tool 12 may store a sample of the native formation fluid 50 or perform a variety of in-situ testing to identify properties of the native formation fluid 50. Accordingly, the pretest system 42, or another module of the downhole tool, may include sensors that may measure fluid properties such as pressures; gas-to-oil ratio (GOR); mass density; optical density (OD); composition of carbon dioxide ($CO_2$), $C_1$, $C_2$, $C_3$, $C_4$, $C_5$, and/or $C_{6+}$; formation volume factor; viscosity; resistivity; conductivity, fluorescence; compressibility, and/or combinations of these properties of the obtained fluid 52. In one example, the pretest system 42 may include a pretest system for sampling a small volume of fluid using a piston or micropiston or a pump. The pretest system may be used to measure a pressure of the fluid, where the pressure measurement is used for further fluid analysis (e.g., to determine fluid mobility). The pretest system 42 may be used to measure the pressure of the volume of fluid from the sample line, the guard line, or both (e.g., a sample volume) over a specified time.

The fluid communication module 46 includes a probe 60, which may be positioned in a stabilizer blade or rib 62. The probe 60 includes one or more inlets for receiving the obtained fluid 52 and one or more flowlines (not shown) extending into the downhole tool 12 for passing fluids (e.g., the obtained fluid 52) through the tool. The probe 60 may include multiple inlets (e.g., a sampling probe and a guard probe) that may, for example, be used for focused sampling. In these embodiments, the probe 60 may be connected to the sampling flowline, as well as to guard flowlines. The probe 60 may be movable between extended and retracted positions for selectively engaging the wellbore wall 58 of the wellbore 14 and acquiring fluid samples from the geological formation 20. One or more setting pistons 64 may be provided to assist in positioning the fluid communication device against the wellbore wall 58.

The sensors within the pretest system 42 may collect and transmit data 70 from the measurement of the fluid properties and the composition of the obtained fluid 52 to a control and data acquisition system 72 at surface 74, where the data 70 may be stored and processed in a data processing system 76 of the control and data acquisition system 72. The data processing system 76 may include a processor 78, memory 80, storage 82, and/or display 84. The memory 80 may include one or more tangible, non-transitory, machine readable media collectively storing one or more sets of instructions for operating the downhole acquisition tool 12 and estimating a mobility of the obtained fluid 52. The memory 80 may store algorithms associated with properties of the native formation fluid 50 (e.g., uncontaminated formation fluid) to compare to properties of the obtained fluid 52. The data processing system 76 may use the fluid property and composition information of the data 70 to estimate a mobility of the obtained fluid 52 in the guard line, the sample line, or both. These estimates may be used to adjust operation of the downhole tool or other equipment.

To process the data 70, the processor 78 may execute instructions stored in the memory 80 and/or storage 82. For example, the instructions may cause the processor 78 to estimate fluid and compositional parameters of the native formation fluid 50 of the obtained fluid 52, and control flow rates of the sample and guard probes, and so forth. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, etc.) relating to properties of the well as measured by the downhole acquisition tool 12. It should be appreciated that, although the data processing system 76 is shown by way of example as being located at the surface 74, the data processing system 76 may be located in the downhole acquisition tool 12. In such embodiments, some of the data 70 may be processed and stored downhole (e.g., within the wellbore 14), while some of the data 70 may be sent to the surface 74 (e.g., in real time or near real time).

FIG. 2 depicts an example of a wireline downhole tool 100 that may employ the systems and methods of this disclosure. The downhole tool 100 is suspended in the wellbore 14 from the lower end of a multi-conductor cable 104 that is spooled on a winch at the surface 74. Like the downhole acquisition tool 12, the wireline downhole tool 100 may be conveyed on wired drill pipe, a combination of wired drill pipe and wireline, or any other suitable conveyance. The cable 104 is communicatively coupled to an electronics and processing system 106. The downhole tool 100 includes an elongated body 108 that houses modules 110, 112, 114, 122, and 124, that provide various functionalities including fluid sampling, sample bottle filling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a fluid communication module 114 that has a selectively extendable probe 116 and backup pistons 118 that are arranged on opposite sides of the elongated body 108. The extendable probe 116 selectively seals off or isolates selected portions of the wall 58 of the wellbore 14 to fluidly couple to the adjacent geological formation 20 and/or to draw fluid samples from the geological formation 20. The probe 116 may include a single inlet or multiple inlets designed for guarded or focused sampling. The native formation fluid 50 may be expelled to the wellbore 14 through a port in the body 108 or the obtained fluid 52, including the native formation fluid 50, may be sent to one or more fluid sampling modules 122 and 124. The fluid sampling modules 122 and 124 may include sample chambers that store the obtained fluid 52. In the illustrated example, the electronics and processing system 106 and/or a downhole control system are configured to control the extendable probe assembly 116 and/or the drawing of a fluid sample from the geological formation 20 to enable analysis of the obtained fluid 52.

Figure 3:
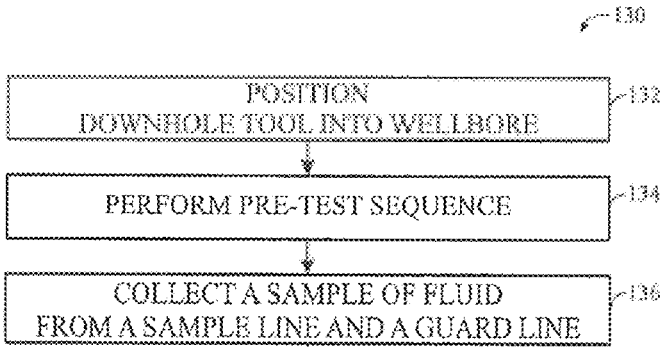
FIG. 3 illustrates a flowchart of a method for performing a pretest sequence, in accordance with an embodiment.
Figure 4:
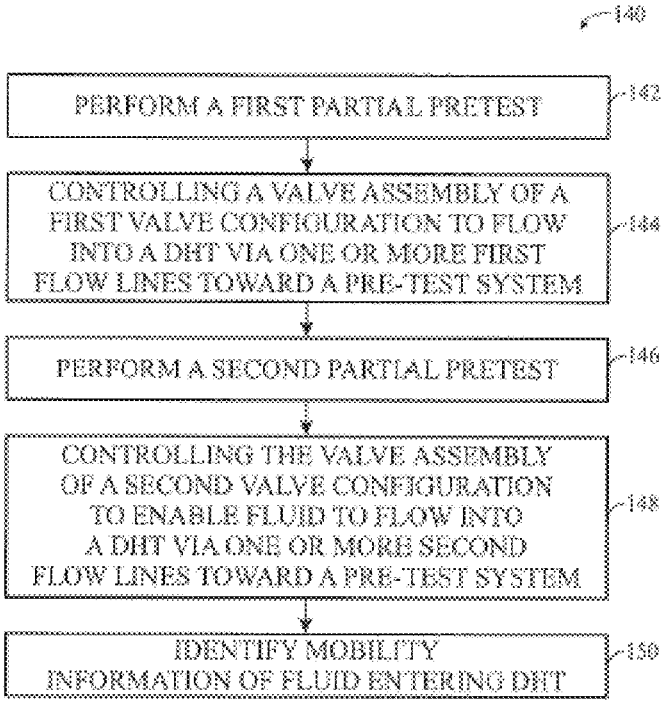
FIG. 4 illustrates a flowchart of a method for performing a pretest sequence, in accordance with an embodiment.

Using these or any other suitable downhole acquisition tools, samples of formation fluids 50 may be obtained at the guard line, the sample line, or both. For example, as shown by a flowchart of FIG. 3, a method 130 of performing the pretest sequence described above is further explained. The method 130 includes positioning (block 132) the downhole tool into the wellbore. The method 130 includes performing (block 134) a pretest sequence. The method 130 ALSO includes collecting a sample of fluid (e.g., formation fluid) from the sample line and the guard line (block 136). As described further below, the sample line and the guard line may influence pressure on one another. The pretest sequence may be further understood with reference to FIG. 4. FIG. 4 is a flowchart illustrating a method 140 of performing the pretest sequence. The method 140 includes performing (block 142) a first partial pretest. The first partial pretest includes controlling (block 144) a valve assembly of a first valve configuration to enable flow of the fluid into the downhole tool assembly. The flow of the fluid into the downhole tool is drawn in through one or more first flow lines in the direction of the pretest system. As described in detail below, the pressure in the first flow lines may be allowed to build while beginning to perform (block 146) a second partial pretest. The method 140 includes controlling (block 148) the valve assembly of a second valve configuration while continuing to draw in the fluid to enable flow of the fluid into the downhole tool assembly after pausing the first partial pretest for a first duration. The flow of the fluid into the downhole tool may be drawn in through one or more second flow lines in the direction of the pretest system. The method 140 includes identifying (block 150) fluid information (e.g., mobility) of the fluid entering the downhole tool. Variations of the steps are possible. For example, the valves can be set to a first configuration, followed by moving the piston to start drawing fluid in the pre-test system. The valves can then be controlled or otherwise set to a second configuration while continuing to draw fluid. The drawing fluid can then be stopped to allow bluid up. Alternatively, the valves can be set to a first configuration, followed by moving the piston to start drawing fluid in the pre-test system. The piston is temporarily stopped to allow a first build-up. The valves are then set to a second configuration and a second pre-test is performed by drawing in fluid, stopping, and allowing the pressure to build up. People skilled in the art can device other alternatives with the benefit of the disclosure from the current application.

Figure 5:
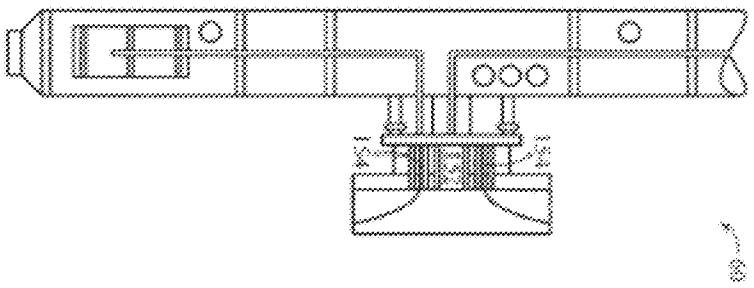
FIG. 5 is a schematic diagram of another example of a wireline wellsite system illustrating a sample line and a guard line used to draw in formation fluids in the wellbore, in accordance with an embodiment.

FIG. 5 is a schematic diagram of another example of a wireline wellsite system illustrating the sample line and the guard line used to draw in formation fluids in the wellbore. An inner sample probe 152 (e.g., the sample line) may be disposed within an outer sample probe 154 (e.g., the guard line) so that the outer sample probe 154 is concentrically disposed around the inner sample probe 152. As may be appreciated, the sample line and the guard line may influence pressure on one another. For example, an increase in pressure in the guard line may result in a higher pressure differential between the guard line and the sample line, thus causing increased flow of certain fluids (e.g., mud filtrate) into the guard line. An aspect of the disclosure includes adjusting the flow rates of the flow lines (e.g., the guard line and/or the sample line) in response to pressure differentials experienced between the flow lines. Adjusting the flow rates of the flow lines may also reduce the stress on the packer created by the larger pressure differential.

Figure 6:
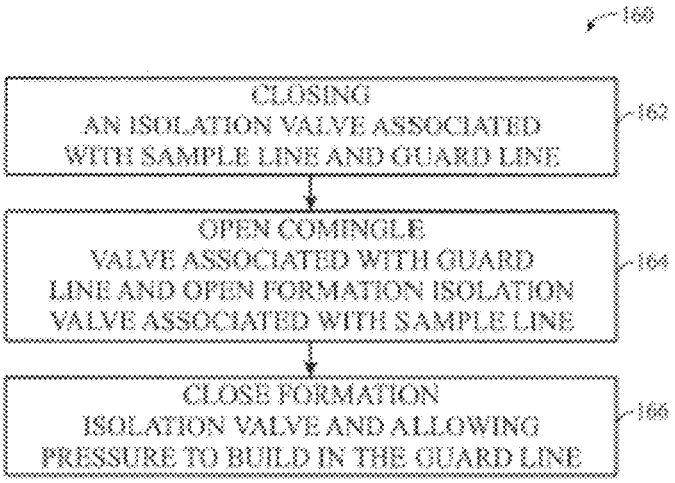
FIG. 6 illustrates a flowchart of a method for performing a first partial pretest, in accordance with an embodiment.

FIG. 6 illustrates a flowchart of a method 160 for performing a first partial pretest (e.g., the guard line), in accordance with an embodiment. The method 160 includes closing (block 162) isolation valves associated with the sample line and the guard line. The method 160 includes leaving open (block 164) a comingle valve associated with the guard line open and opening a formation isolation valve associate with the sample line. The method 160 includes performing a pretest drawdown. The method 160 includes closing the formation isolation valve and allowing (block 166) pressure to build within the guard line. As explained further with reference to FIGS. 7-9, the first partial pretest includes isolating flow within the flow lines to enable selective pressure build up within the flow lines.

Figure 7:
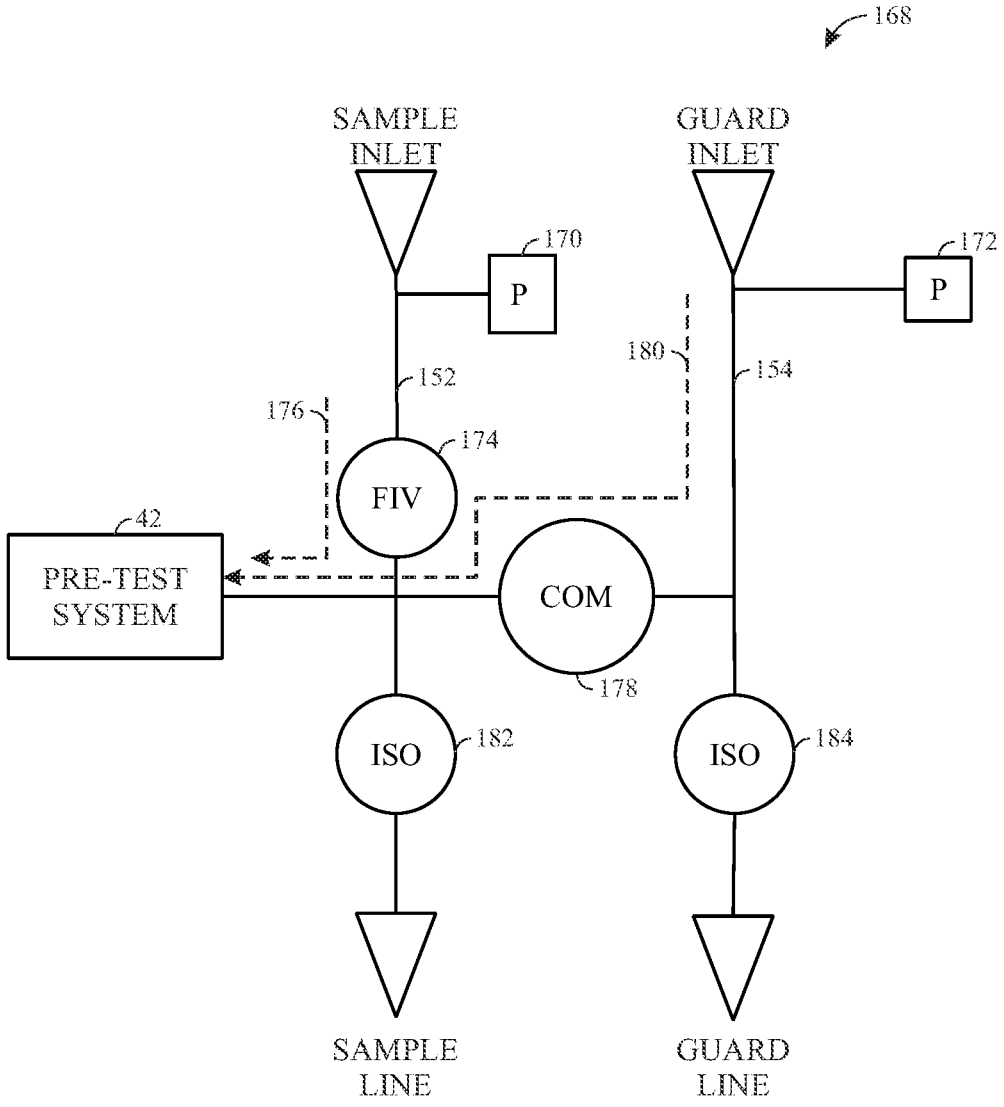
FIG. 7 is a schematic diagram representing fluid flow through flow lines toward a pretest system, in accordance with an embodiment.
Figure 8:
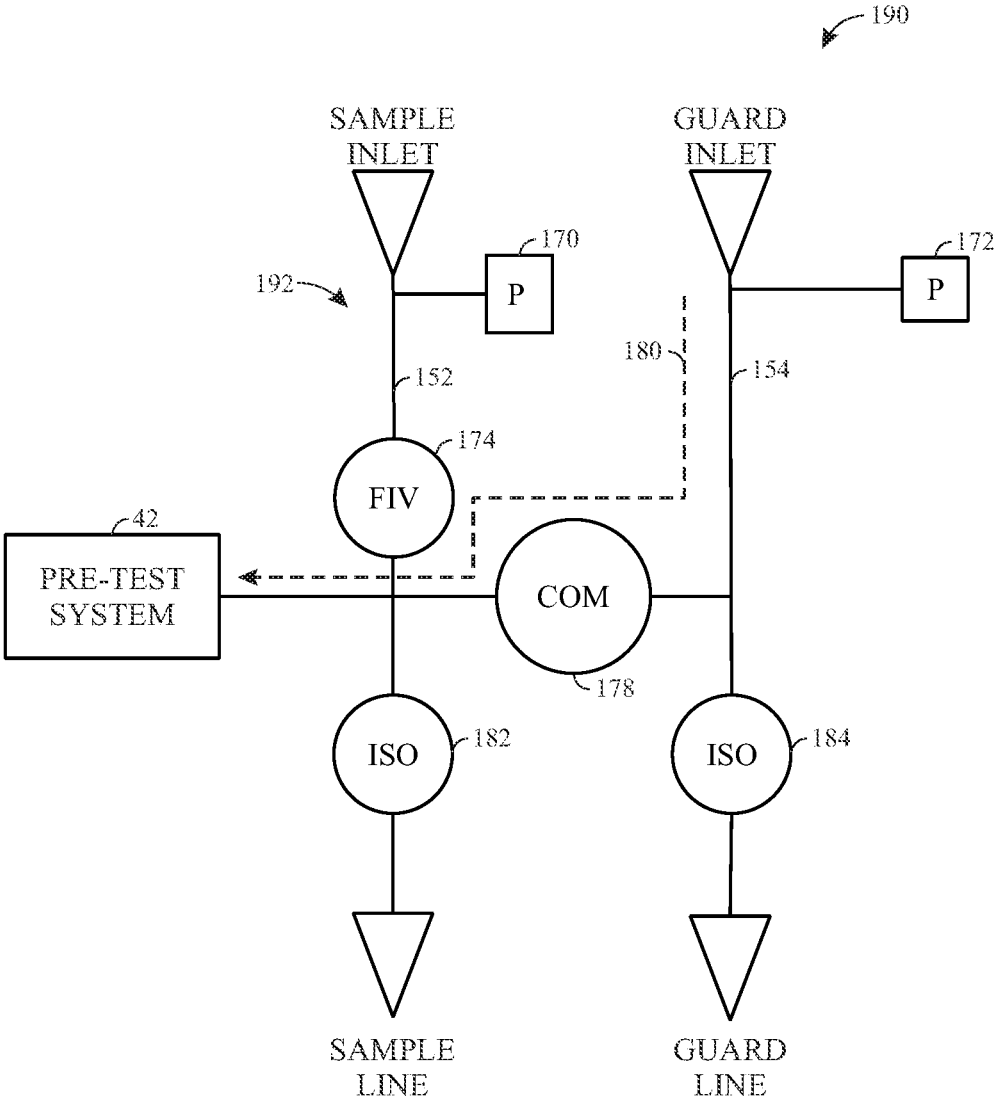
FIG. 8 is a schematic diagram representing fluid flow through flow lines toward a pretest system, in accordance with an embodiment.
Figure 9:
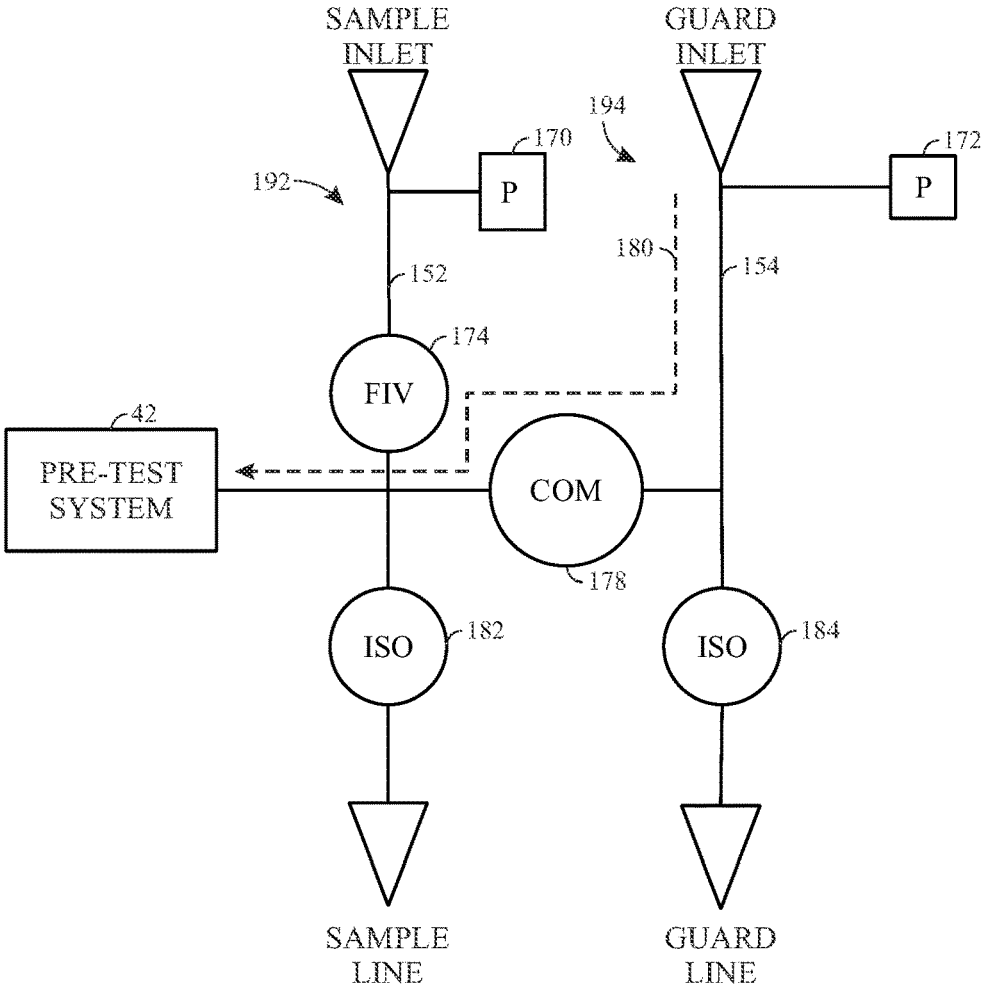
FIG. 9 is a schematic diagram representing fluid flow through flow lines toward a pretest system, in accordance with an embodiment.

FIGS. 7-9 are schematic diagrams representing fluid flow through flow lines toward a pretest system, in accordance with an embodiment. FIG. 7 illustrates a first step 168 of the fluid flow paths associated with the first partial pretest. Both the sample line 152 and the guard line 154 include isolation valves 182, 184 to stop flow of the fluids through the sample line 152 and the guard line 154, respectively. The illustrated embodiment involves drawing fluids in through the sample line 152 and the guard line 154. The pressure of the sample line 152 and the guard line 154 are monitored by pressure gauges 170, 172 for the respective lines. A formation isolation valve 174 controls the flow of the fluid through the sample line 152 and is opened in the first step 168. In the illustrated embodiment, the fluid flows through the sample line 152 as indicated by a dashed line 176. A comingle valve 178 controls the flow of the fluid through the guard line 154 and is opened in the first step 168. The flow path of the fluid in the guard line 154 is indicated by dashed line 180. In the first step 168, the pretest system 42 (e.g., a piston) is moved to enable fluid flow from the sample line 152 and the guard line 154. FIG. 8 illustrates a second step 190 of the fluid flow paths associated with the first partial pretest. In the second step 190, the formation isolation valve 174 of the sample line 152 is closed to stop the flow of the fluid through the sample line 152. The comingle valve 178 associated with the guard line 154 remains open to enable the flow 180 to continue through the guard line 154. When the formation isolation valve 174 is closed, pressure begins to build in the sample line 152 as indicated by arrow 192. When the pretest system 42 (e.g., piston) stops moving, the pressure also begins to build up in the guard line as indicated by arrow 194 shown in FIG. 9. It may be appreciated the pressure build up indicated by arrows 192 and 194 may occur at substantially the same time, thereby reducing the overall time for pressure build up time. Other variations may be implemented. For example, the first pretest can be performed with fluid from both sample line 152 and guard line 154. The comingle valve 178 can be closed to stop flow from the guard line 154, with fluid continued to flow through the sample line 152.

Figure 10:
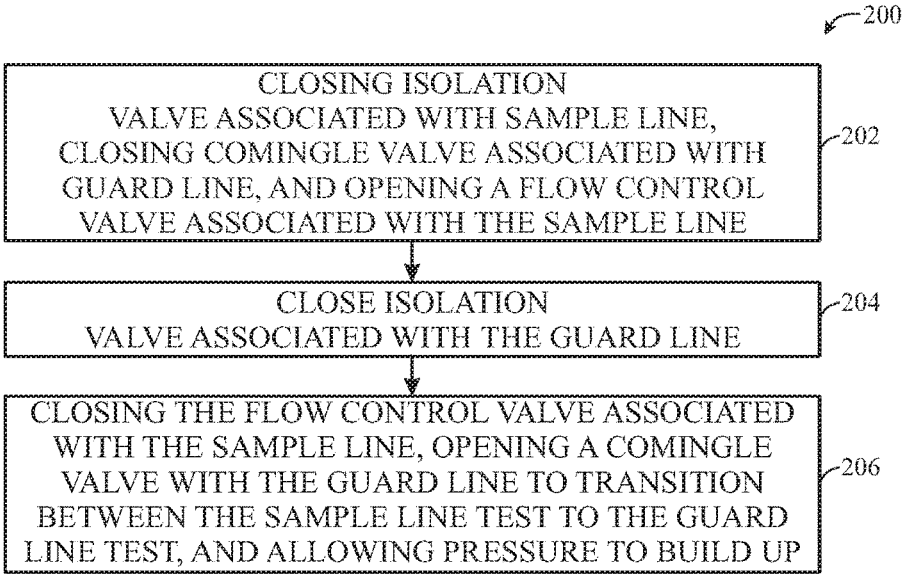
FIG. 10 illustrates a flowchart of a method for performing a second partial pretest, in accordance with an embodiment.

FIG. 10 illustrates a flowchart of a method 200 for performing a second partial pretest, in accordance with an embodiment. The method includes closing (block 202) a first valve assembly having an isolation valve associated with the sample line and a comingle valve associated with the guard line and opening a formation isolation valve associated with the sample line. The method 200 includes closing (block 204) a second valve assembly having an isolation valve associated with the guard line. The method 200 includes closing the formation isolation valve associated with the sample line, opening a comingle valve associated with the guard line, and allowing (block 206) pressure to build within the guard line. As explained further with reference to FIGS. 11-14, the second partial pretest includes isolating flow within the flow lines to enable selective pressure build up within the flow lines.

Figure 11:
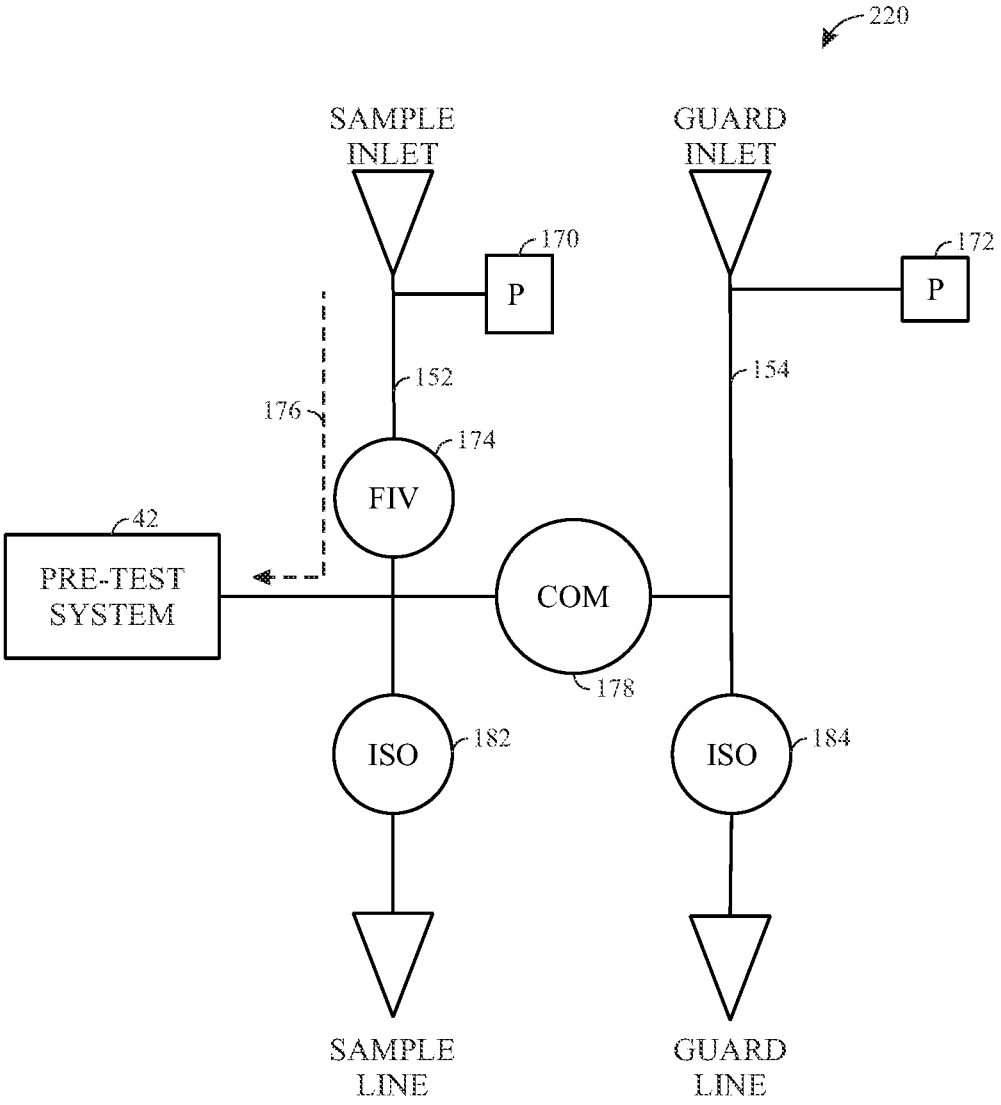
FIG. 11 is a schematic diagram representing fluid flow through flow lines toward a pretest system, in accordance with an embodiment.

FIGS. 11-14 are schematic diagrams representing fluid flow through flow lines toward a pretest system, in accordance with an embodiment. FIG. 11 illustrates a first step 220 of the fluid flow paths associated with the second partial pretest. Both the sample line 152 and the guard line 154 include isolation valves 182, 184 to stop flow of the fluids through the sample line 152 and the guard line 154, respectively. The pressure of the sample line 152 and the guard line 154 are monitored by pressure gauges 170, 172 for the respective lines. The illustrated embodiment involves drawing fluids in through the sample line 152 only. A formation isolation valve 174 controls the flow of the fluid through the sample line 152 and is opened in the first step 220. The sample isolation valve 182 and the comingle valve 178 are closed. In the illustrated embodiment, the fluid flows through the sample line 152 as indicated by a dashed line 176. The guard isolation valve 184 remains closed in the first step 220. The pretest system 42 (e.g., piston) is moved to enable the fluid in the sample line 152 to continue to flow through the sample line as indicated by dashed line 176.

Figure 12:
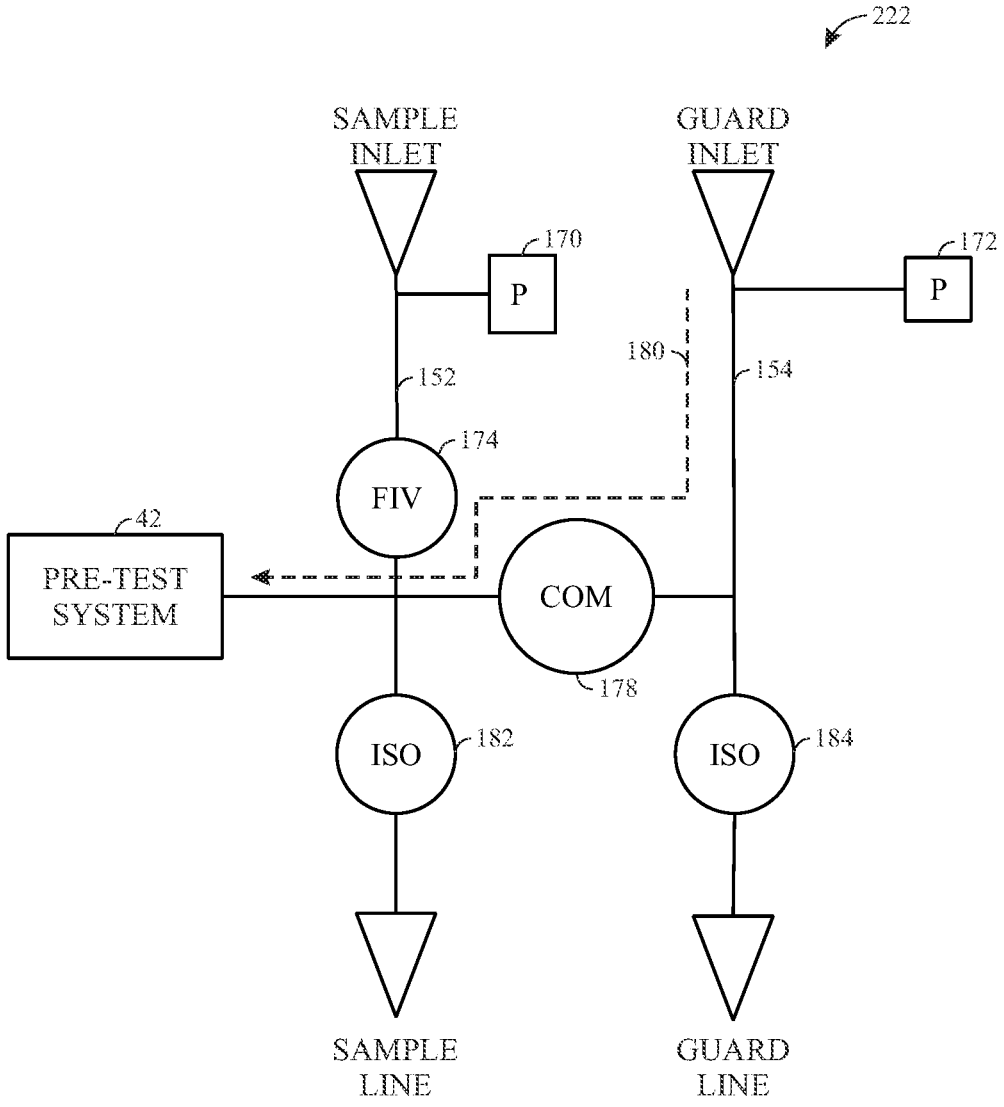
FIG. 12 is a schematic diagram representing fluid flow through flow lines toward a pretest system, in accordance with an embodiment.
Figure 13:
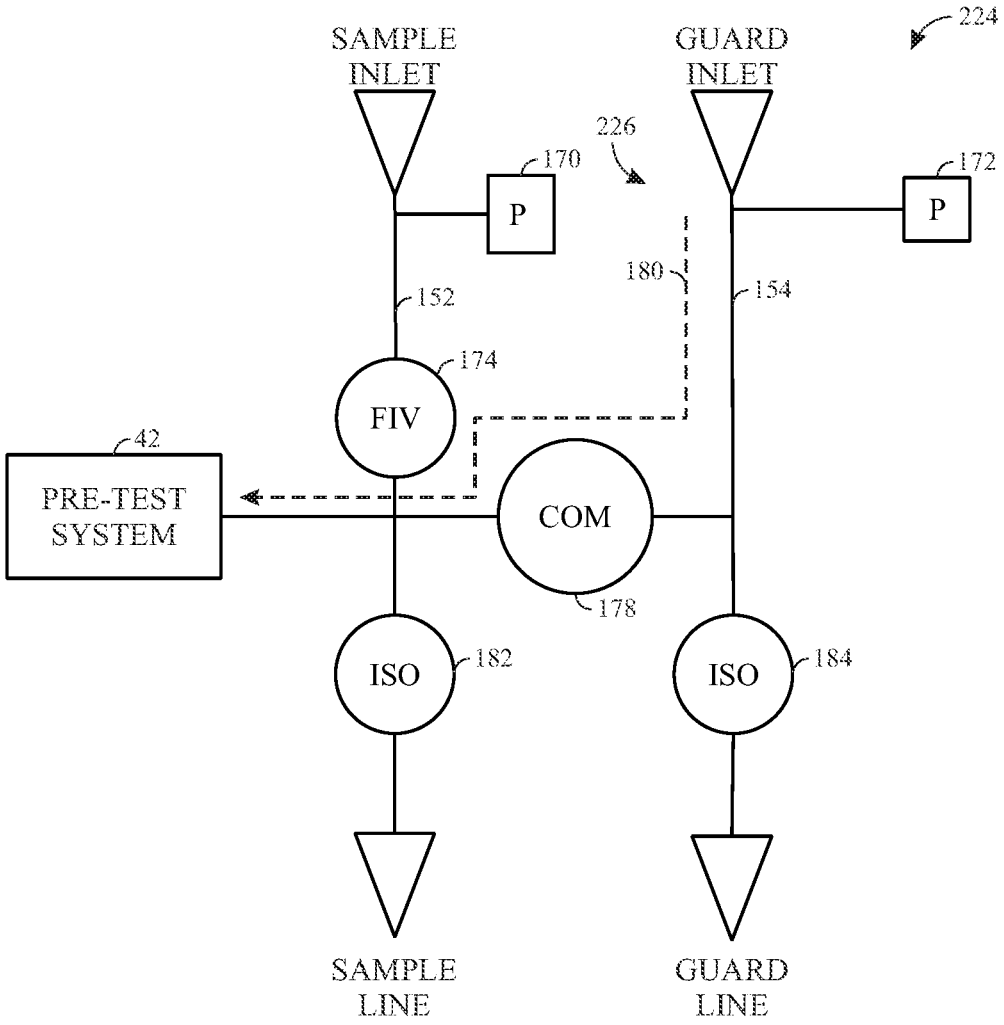
FIG. 13 is a schematic diagram representing fluid flow through flow lines toward a pretest system, in accordance with an embodiment.

FIG. 12 illustrates a second step 222 of the second partial pretest. In the second step 222, the formation isolation valve 174 is closed and the comingle valve 178 is opened. In the illustrated embodiment, the flow through the sample line 152 has stopped and the flow continues only through the guard line 154, as indicated by dashed line 180. FIG. 13 illustrates a third step 224 of the second partial pretest. In the third step 224, the formation isolation valve 174 remains closed, while the flow continues only through the guard line 154. When the pretest system 42 (e.g., piston) stops moving, the pressure also begins to build up in the guard line 154 as indicated by arrow 226.

In certain embodiments, as further illustrated in FIGS. 14-22 below, the downhole acquisition tool 12 may include a dual flowline radial probe rather than the probe 60 (e.g., a focused probe). The process for sample and guard line pretesting may be different for a radial probe compared to a focused probe. For example, the radial probe may use a pump module, rather than a piston, to draw fluid from the formation into the sample line and the guard line. FIGS. 23 and 24 illustrate radial probes that may be used for pretesting the native formation fluid 50. For example, FIG. 23 illustrates a dual flowline radial probe 400 having two pump modules 406, 408 used with the dual flowline radial probe that include pumps used to draw the native formation fluid 50 into a sample line 410 and/or a guard line 412. Each pump module 406, 408 may be associated with one of the sample line 410 or the guard line 412, such that each line 410, 412 may have a dedicated pump module 406, 408. In certain embodiments, the radial probe 400 may include only one pump module 406,408, as illustrated in FIG. 24. As such, the pump module 406, 408 may be used to draw in the native formation fluid 50 for both the lines 410, 412. Similar to the probe 60, the radial probe 400 includes a sample isolation valve 416 and a guard isolation valve 418 that allow or block a flow of the obtained fluid 52 in the sample line 410 and guard line 412, respectively, into the pretesting system 42. Additionally, the radial probe 400 includes a comingle valve 420 that allows fluid communication between the sample line 410 and guard line 412.

Figure 14:
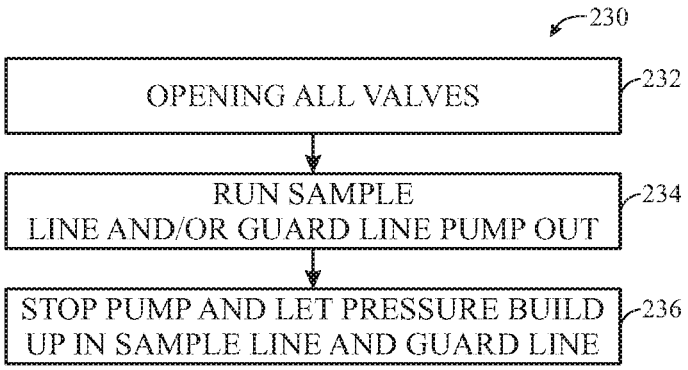
FIG. 14 illustrates a flowchart of a method for performing a pretest from the sample line and the guard line are drawn in through the flow lines, in accordance with an embodiment.

FIG. 14 illustrates a flowchart of a method 230 for performing a pretest from the sample line and the guard line, in accordance with an embodiment. The method 230 includes sampling a comingled fluid, including both the fluid from the sample line 254 and the fluid from the guard line 256. The method 230 includes opening (block 232) all of the valves associated with the guard line 254 and the guard line 256. For example, the formation isolation valve associated with the sample line, the comingle valve associated with the guard line, and all of the isolation valves are opened. The method 230 includes running (block 234) the sample line pump and the guard line pump. The method 230 includes stopping (block 236) the pump and letting pressure build up in the sample line and the guard line.

Figure 15:
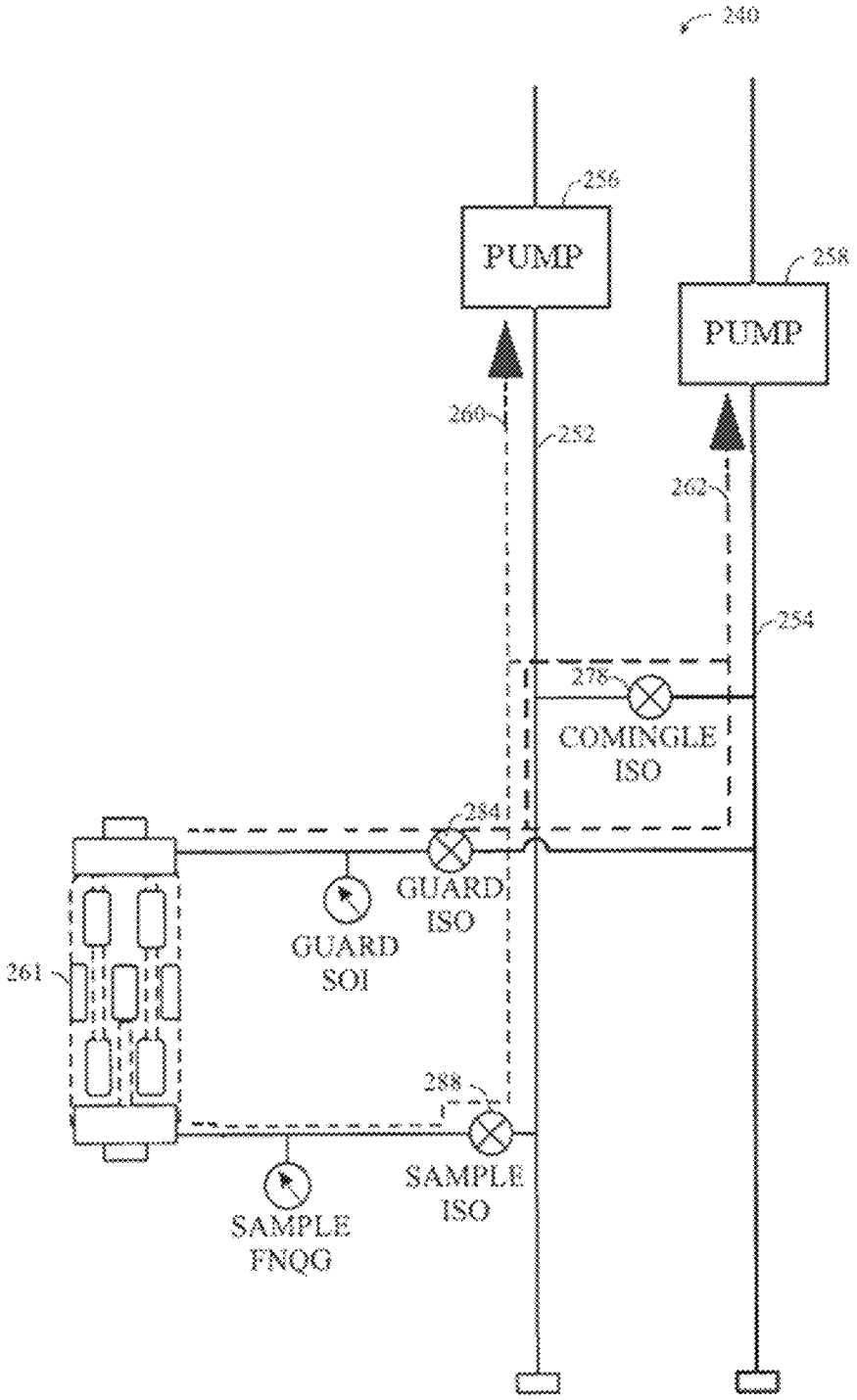
FIG. 15 is a schematic diagram representing fluid flow through flow lines from a packer, in accordance with an embodiment.
Figure 16:
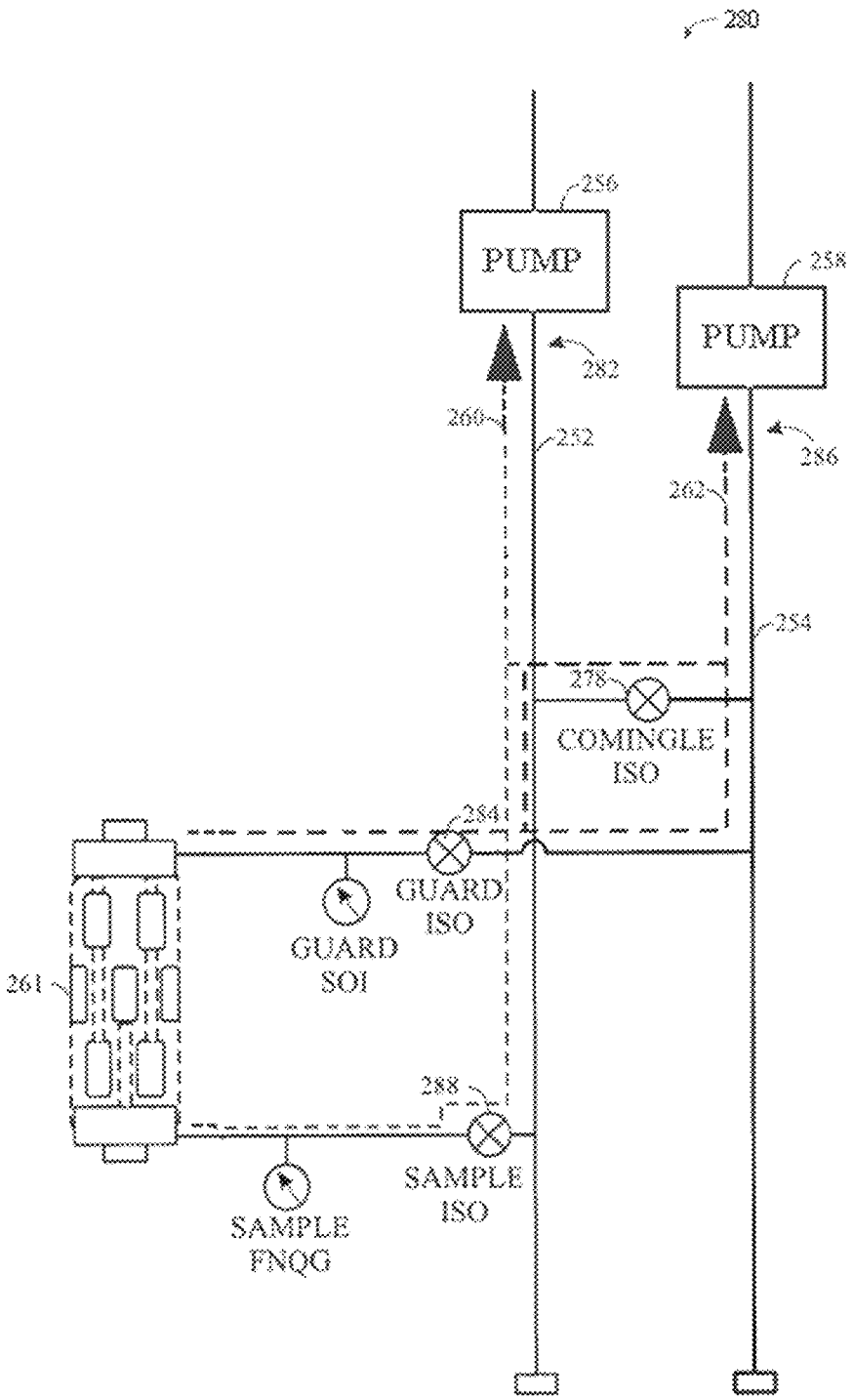
FIG. 16 is a schematic diagram representing fluid flow through flow lines from a packer, in accordance with an embodiment.

FIGS. 15-16 are schematic diagrams representing fluid flow through flow lines from a packer, in accordance with an embodiment. FIG. 15 illustrates a first step 240 of the pretest from the sample line 252 and the guard line 254. In the illustrated embodiment, the isolation valve 284 associated with the guard line and the comingle valve 278 associated with the guard line 254 are opened. A sample line pump 256 and a guard line pump 258 run to enable flow through the sample line 252 and the guard line 254, as illustrated by dashed lines 260 and 262, respectively. FIG. 16 illustrates a second step 280 of the pretest from the sample line 252 and the guard line 254. In the second step 280, a pressure build up in the sample line 252 and the guard line 254 is indicated by arrows 282 and 286 respectively. Isolation valve 288 can be used to regulate the flow in the sample line 252.

Figure 17:
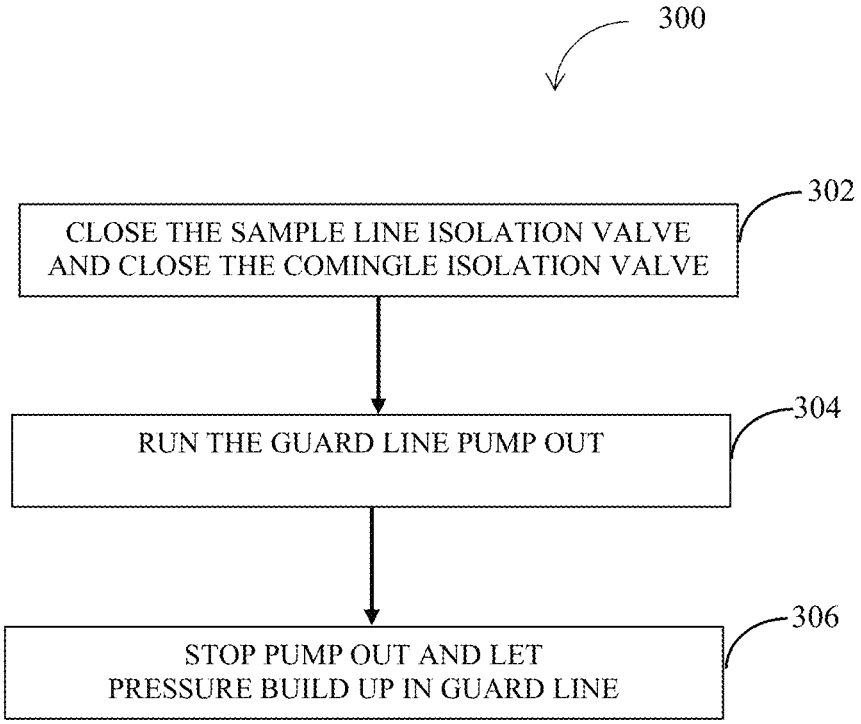
FIG. 17 illustrates a flowchart of a method for performing a first partial pretest, in accordance with an embodiment.

FIG. 17 illustrates a flowchart of a method 300 for performing a first partial pretest, in accordance with an embodiment. The method 300 includes closing (block 302) the isolation valve associated with the sample line and closing the comingle valve. The method 300 includes running (block 304) the guard line pump. The method includes stopping (block 306) the guard line pump and letting pressure build up in the guard line.

Figure 18:
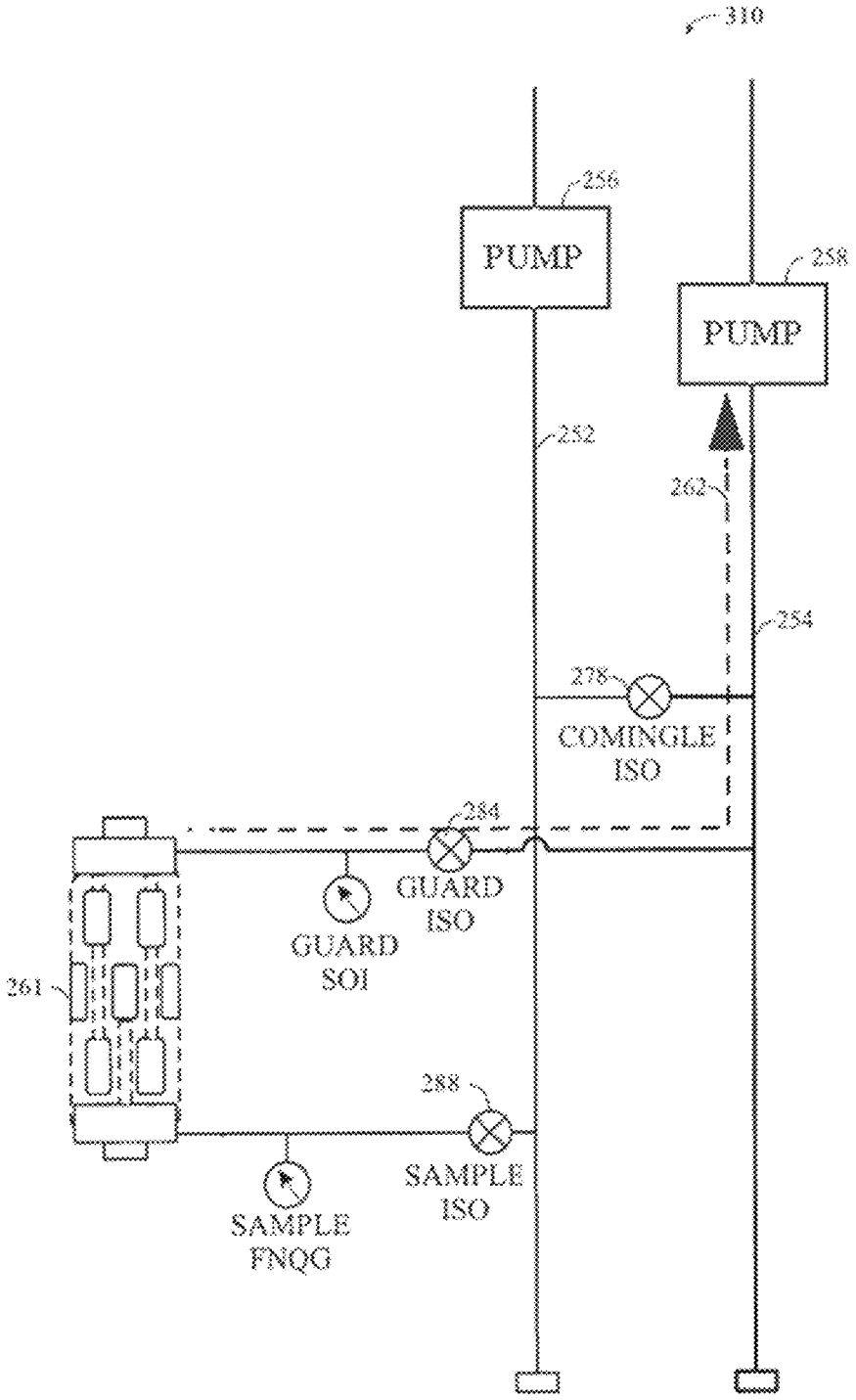
FIG. 18 is a schematic diagram representing fluid flow through flow lines from a packer, in accordance with an embodiment.
Figure 19:
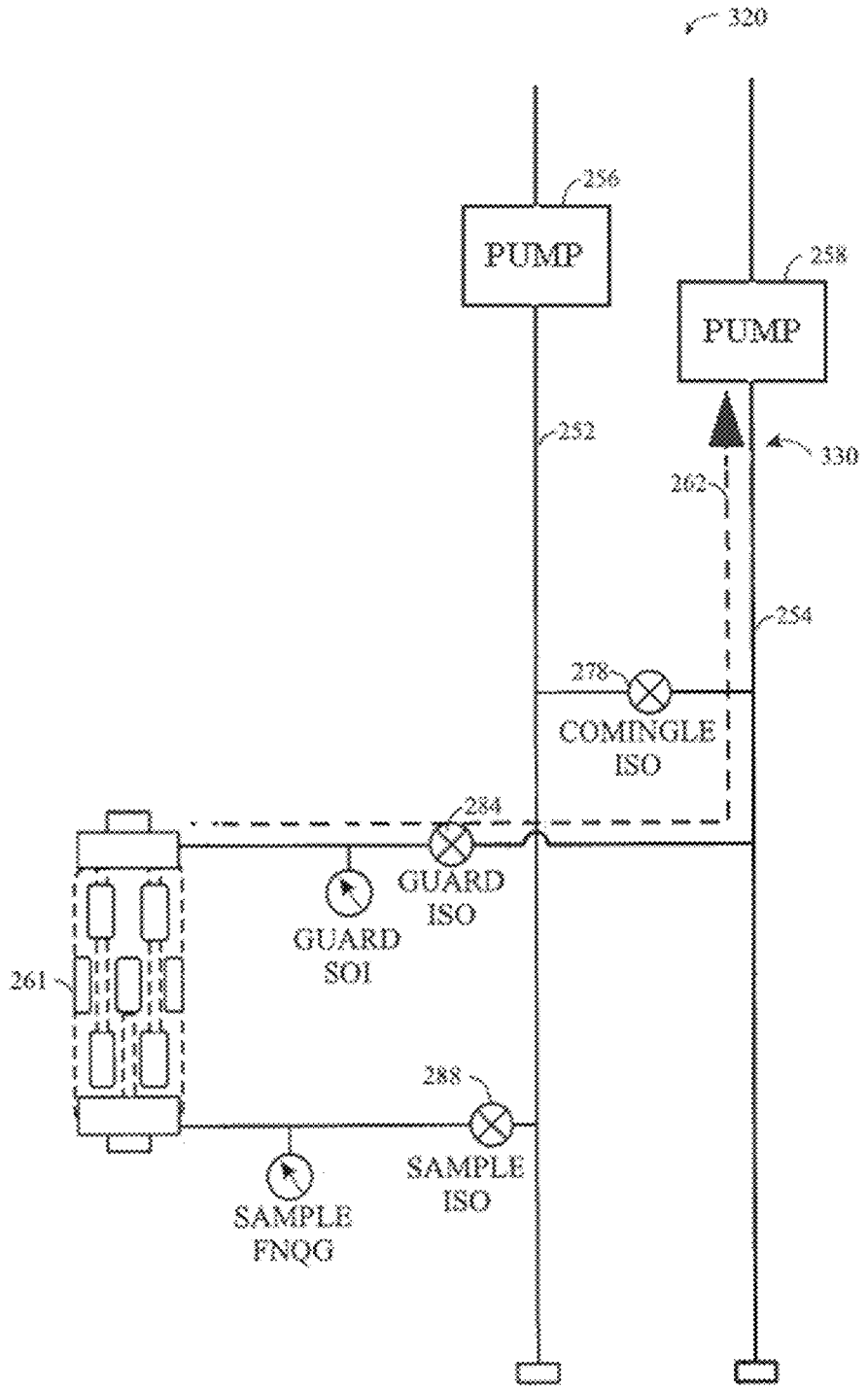
FIG. 19 is a schematic diagram representing fluid flow through flow lines from a packer, in accordance with an embodiment.

FIGS. 18-19 are schematic diagrams representing fluid flow through flow lines from a packer 261, in accordance with an embodiment. FIG. 18 illustrates a first step 310 of the first partial pretest (e.g., the guard line pretest). In the illustrated embodiment, the isolation valve associated with the sample line 252 and the comingle valve 278 associated with the guard line 254 are closed. The guard line pump 258 runs to control the flow through the guard line 254. FIG. 19 illustrates a second step 320 of the first partial pretest. In the second step 320, the pressure build up in the guard line 254 is allowed to build up, as indicated by arrow 330.

Figure 20:
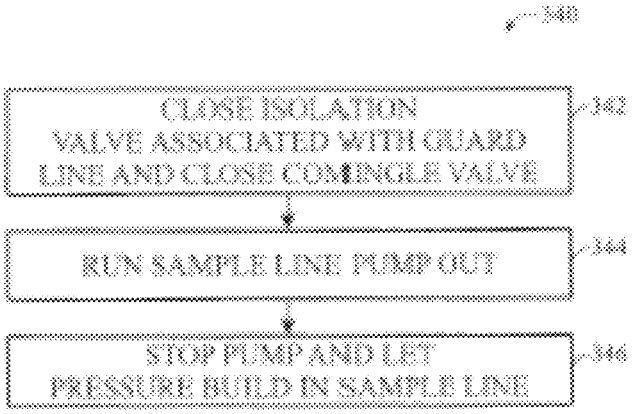
FIG. 20 illustrates a flowchart of a method for performing a second partial pretest, in accordance with an embodiment.

FIG. 20 illustrates a flowchart of a method 340 for performing a second partial pretest, in accordance with an embodiment. In the illustrated embodiment, the flow through the sample line 252 and the guard line 254 are controlled via a sample line pump 256 and a guard line pump 258. The method 340 includes closing (block 342) the isolation valve 284 associated with the guard line and closing the comingle valve 278 associated with the guard line 254. The method 340 includes running (block 344) the sample line pump to control the flow of fluid through the sample line 252. The method 340 includes stopping the pump (block 346) and letting the pressure build up in the sample line 252.

Figure 21:
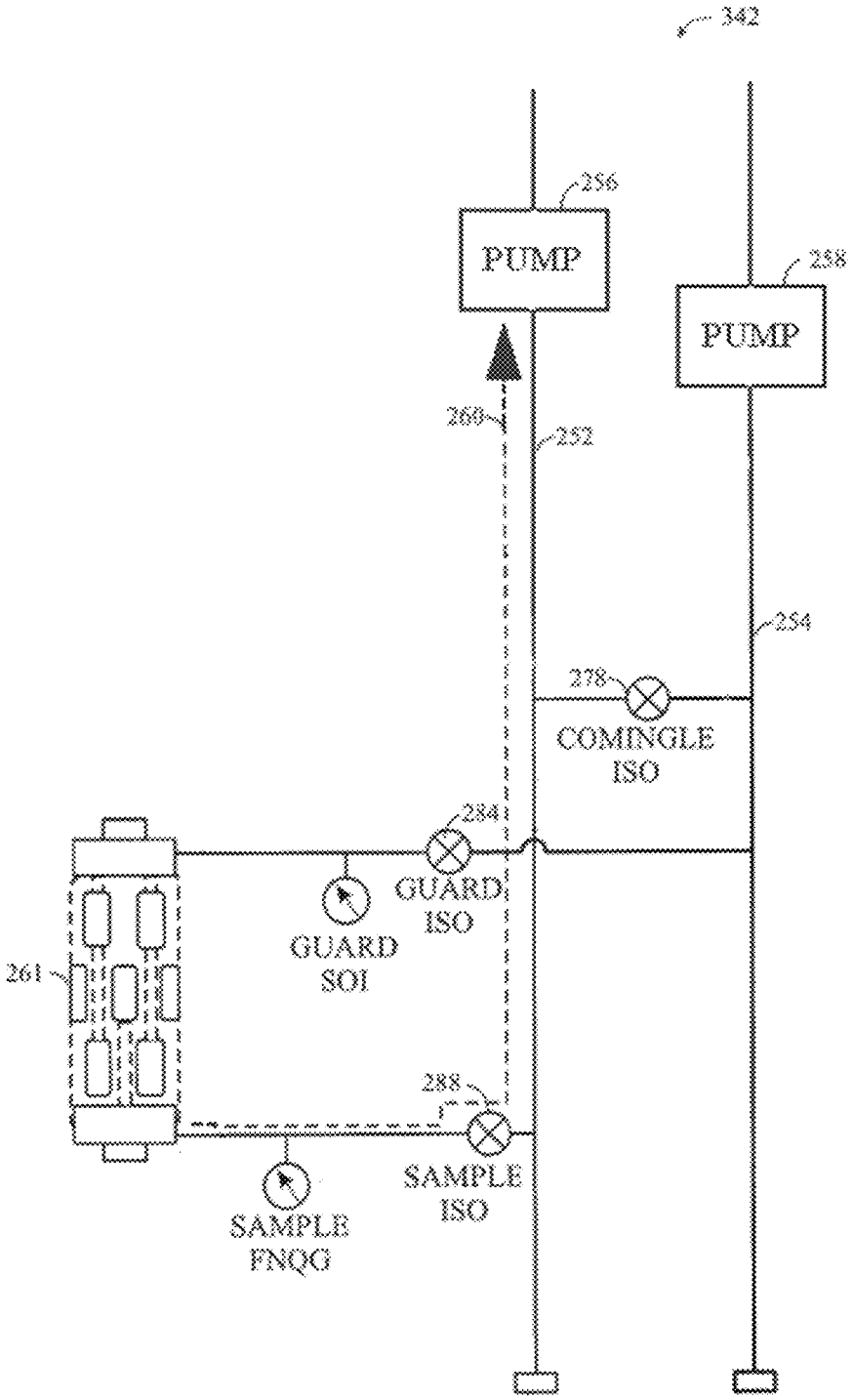
FIG. 21 is a schematic diagram representing fluid flow through flow lines from a packer, in accordance with an embodiment.
Figure 22:
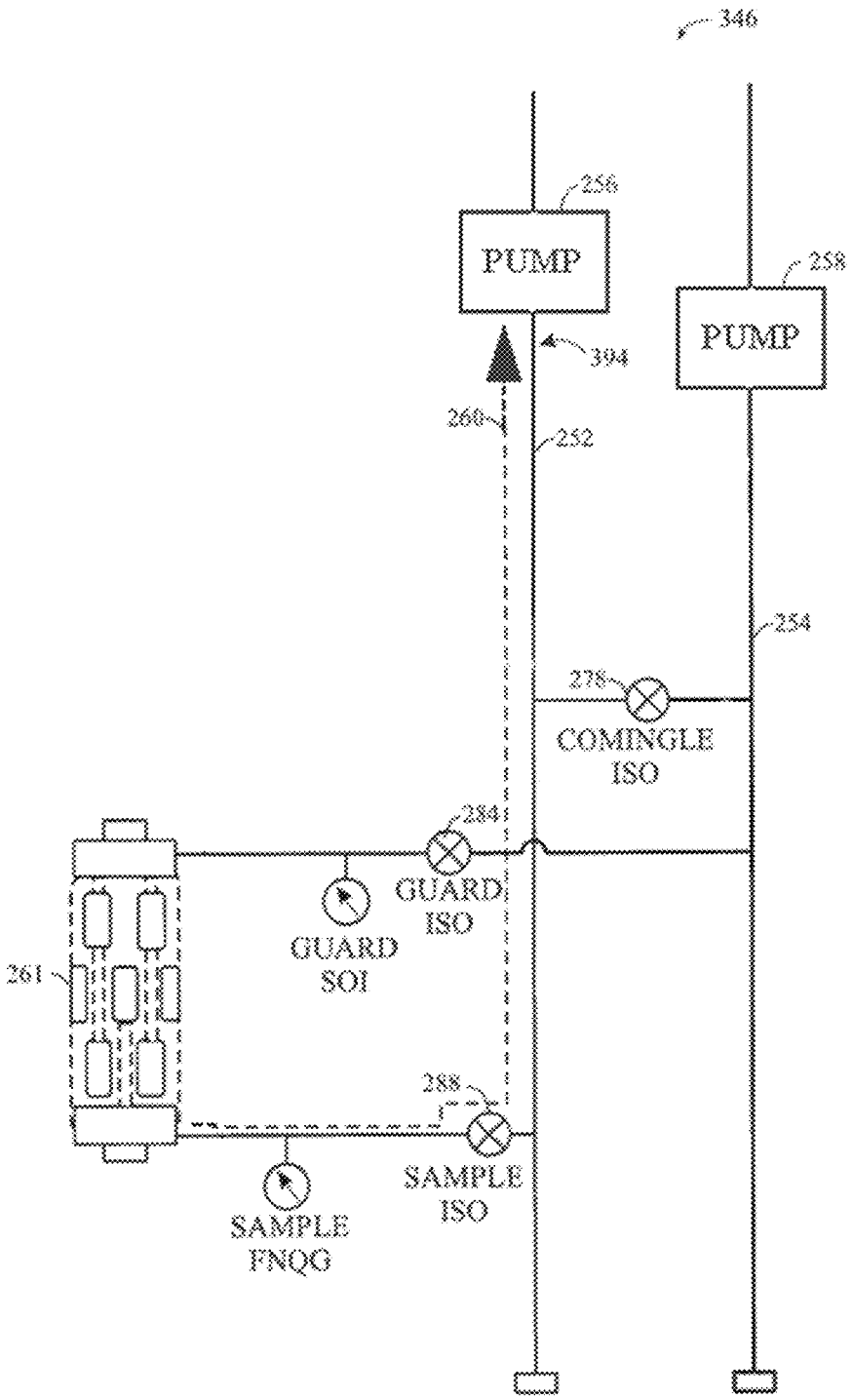
FIG. 22 is a schematic diagram representing fluid flow through flow lines from a packer, in accordance with an embodiment.

FIGS. 21-22 are schematic diagrams representing fluid flow through flow lines from a packer 261, in accordance with an embodiment. FIG. 21 illustrates a first step 342 of the second partial pretest (e.g., the sample line pretest). In the illustrated embodiment, the isolation valve 284 associated with the guard line and the comingle valve 278 associated with the guard line 254 are closed. The sample line pump 256 runs to control the flow through the sample line 252. FIG. 22 illustrates a second step 346 of the second partial pretest. The second step 346, illustrates allowing the pressure to build up in the sample line 252, as indicated by arrow 394.

Performing pretests using the radial probe 400 may be non-sequenced or sequenced for both sample and guard lines 410, 412, respectively. FIGS. 25-29 illustrate non-sequenced pretests methods that may be used with the radial probe 400. For example, FIG. 25 is flow diagram of a method 430 for performing a sample line non-sequenced pretest, in accordance with an embodiment. Each method (e.g., non-sequenced and sequenced) disclosed herein for the radial probe 400 begin with all the valves (e.g., valves 416, 418, 420) being open at the start of the pretests. Accordingly, the method 430 includes closing (block 432) the guard isolation valve 418 and the comingle valve 420. By closing the guard isolation valve 418 and the comingle valve 420, the obtained fluid 52 from the guard line 412 may not flow into the pretest system 42. Following closing of the valves 418, 420, the method 430 includes running (block 436) the sample line pump. The method 430 also includes stopping (block 438) the sample line pump and allowing (block 440) pressure to build up at the sample line inlet. In certain embodiments, the sample line isolation valve 416 may be closed simultaneously (or semi-simultaneously) when the sample line pump is stopped.

In an alternative embodiment, the guard line pump rather than the sample line pump may be run. For example, FIG. 26 illustrates another example of a flow diagram of method 446 for performing a sample line non-sequenced pretest, in accordance with an embodiment. Similar to the method 430, the method 446 includes closing (block 448) the guard isolation valve 418. However, in this particular embodiment, the comingle valve 420 remains open. Following closing of the guard isolation valve 418, the method 446 includes running (block 450) the guard line pump. During running of the guard line pump, the sample line is closed above and below the radial probe module (e.g., the radial probe 400). The method 446 also includes stopping (block 454) the guard line pump and allowing (block 440) pressure to build up at the sample line inlet. In certain embodiments, the sample line isolation valve 416 may be closed simultaneously (or semi-simultaneously) when the guard line pump is stopped.

Figure 27:
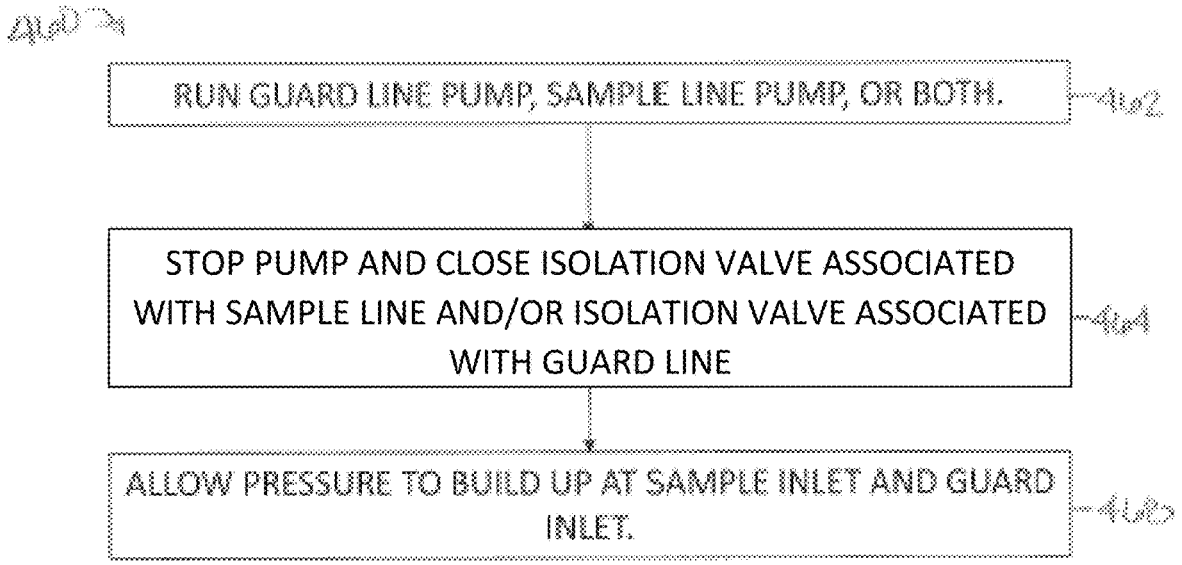
FIG. 27 illustrates a flowchart of a method for performing a non-sequenced comingled pretest using the wireline wellsite system of FIGS. 23 and 24, in accordance with an embodiment.

In certain embodiments, it may be desirable to run a comingled non-sequenced pretest. FIG. 27 illustrates a flow diagram of a method 460 for performing a comingled non-sequenced pretest, in accordance with an embodiment. The method 460 includes running (block 432) the sample line pump, the guard line pump, or both. The method 460 also includes stopping (block 464) the sample line pump and/or the guard line pump and allowing (block 468) pressure to build up at the sample line inlet and the guard inlet. In certain embodiments, the sample line isolation valve 416 and/or the guard line isolation valve 418 may be closed simultaneously (or semi-simultaneously) when the sample line pump and/or the guard line pump is stopped.

Figure 29:
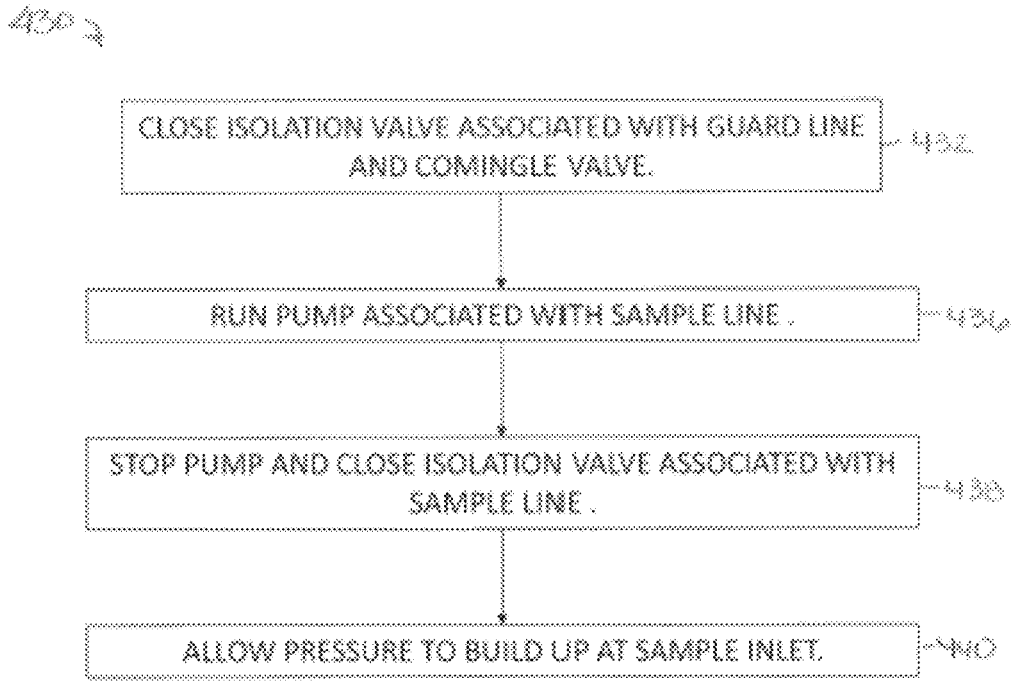
FIG. 29 illustrates a flowchart of a method of another example for performing a non-sequenced guard line pretest using the wireline wellsite system of FIGS. 23 and 24, whereby the fluid through the flowlines of the wireline wellsite system are comingled, in accordance with an embodiment.
Figure 28:
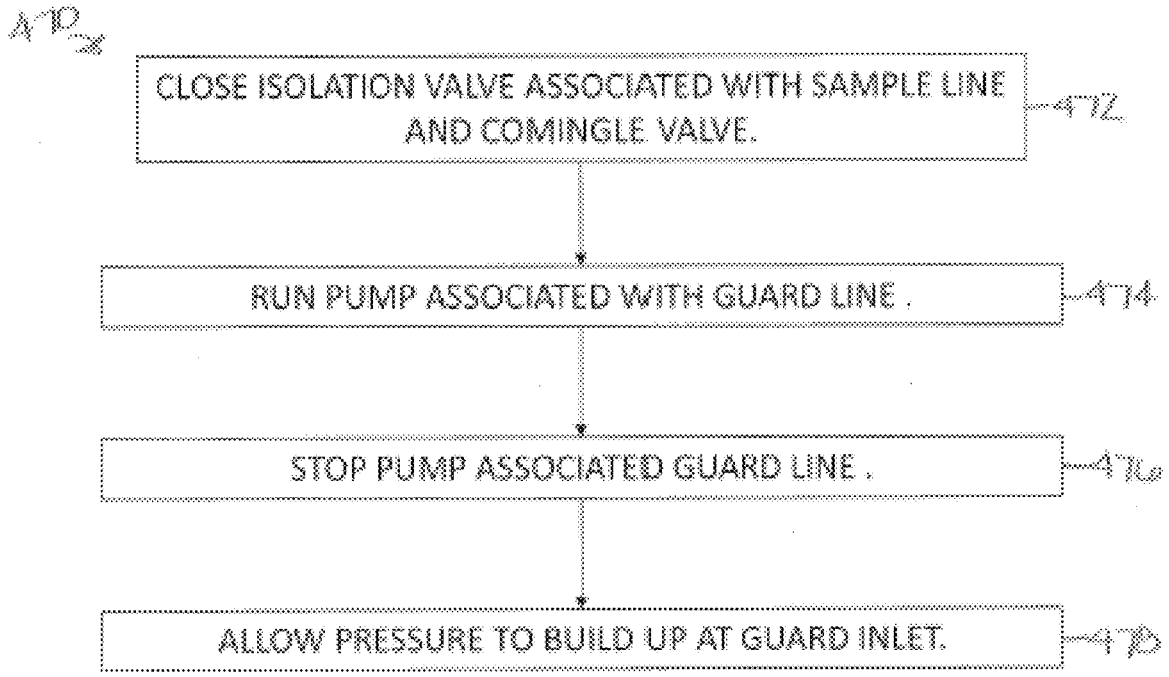
FIG. 28 illustrates a flowchart of a method for performing a non-sequenced guard line pretest using the wireline wellsite system of FIGS. 23 and 24, whereby the fluid through the flowlines of the wireline wellsite system are comingled, in accordance with an embodiment.
Figure 29:
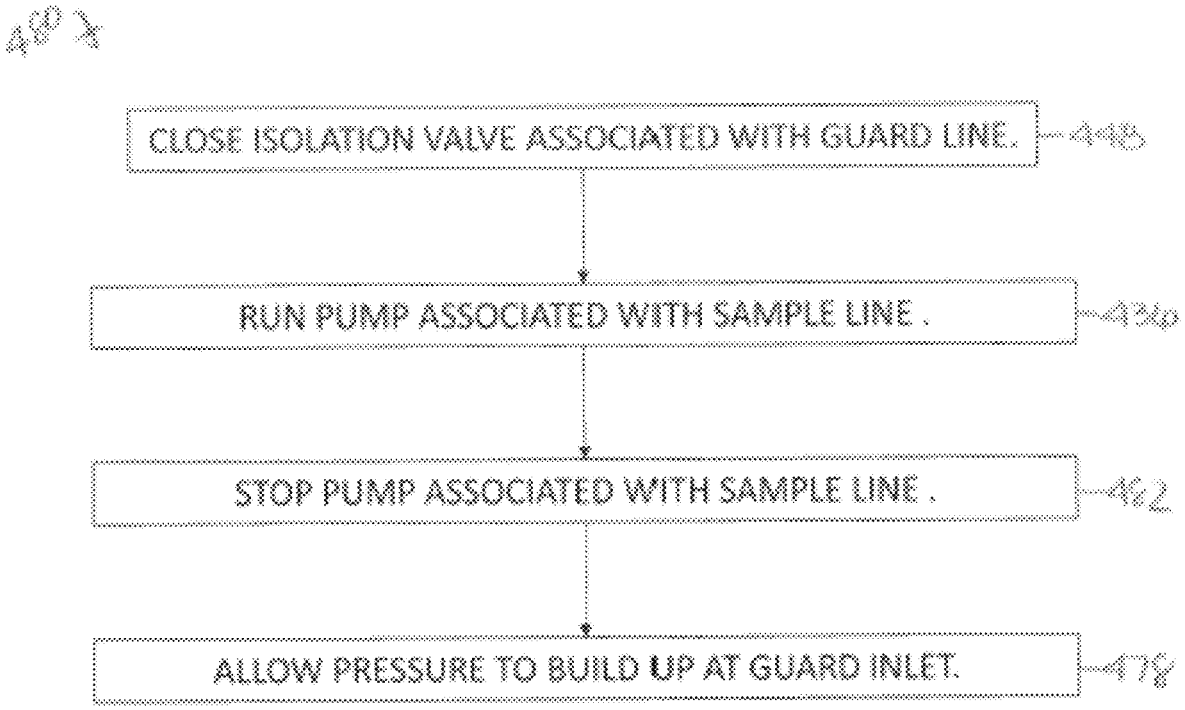
Figure 30:
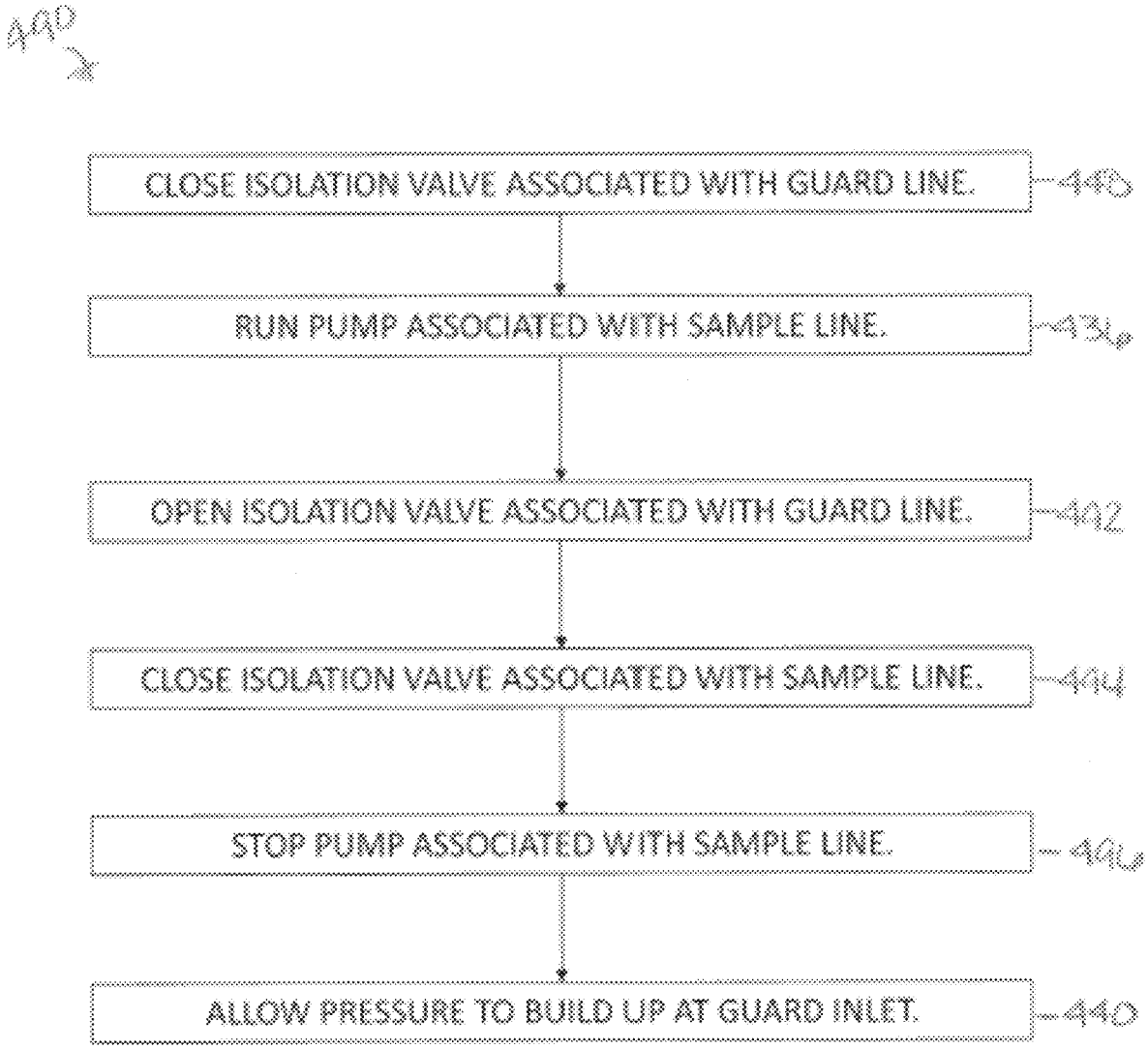

Embodiments of the present disclosure also include performing guard line non-sequenced pretests. FIGS. 28 and 29 illustrate methods for performing guard line non-sequenced pretests. For example, FIG. 28 illustrates a flow diagram of a method 470 includes closing (block 472) the sample isolation valve 416 and the comingle valve 420. By closing the sample isolation valve 416 and the comingle valve 420, the obtained fluid 52 from the sample line 410 may not flow into the pretest system 42. Following closing of the valves 416, 420, the method 470 includes running (block 474) the guard line pump. The method 470 also includes stopping (block 476) the guard line pump and allowing (block 478) pressure to build up at the guard line inlet. In certain embodiments, the guard line isolation valve 418 may be closed simultaneously (or semi-simultaneously) when the guard line pump is stopped.

In another embodiment, the sample line pump rather than the guard line pump may be run. For example, FIG. 29 illustrates another example of a flow diagram of method 480 for performing a guard line non-sequenced pretest, in accordance with an embodiment. Similar to the method 470, the method 480 includes closing (block 448) the guard isolation valve 418. However, in this particular embodiment, the comingle valve 420 remains open. Following closing of the guard isolation valve 418, the method 480 includes running (block 436) the sample line pump. The method 480 also includes stopping (block 482) the sample line pump and allowing (block 478) pressure to build up at the guard line inlet. In certain embodiments, the guard line isolation valve 418 may be closed simultaneously (or semi-simultaneously) when the sample line pump is stopped to facilitate pressure build up at the guard line inlet.

The guard line pretests using the radial probe 400 may also be acquired in series. For example, when the guard line pretest is acquired in series, the process may include sample line inlet draw down, sample line inlet pressure build up, guard line inlet draw down, and guard line inlet pressure build up. The build up times may be undesirable (e.g., may take several minutes to hours). Therefore, it may be desirable if the sample and guard line inlet pressure build up occurred simultaneously such that an amount of time for the pretest is decreased compared to process where the sample and guard line pressure build up is performed in separate steps.

Figure 30:
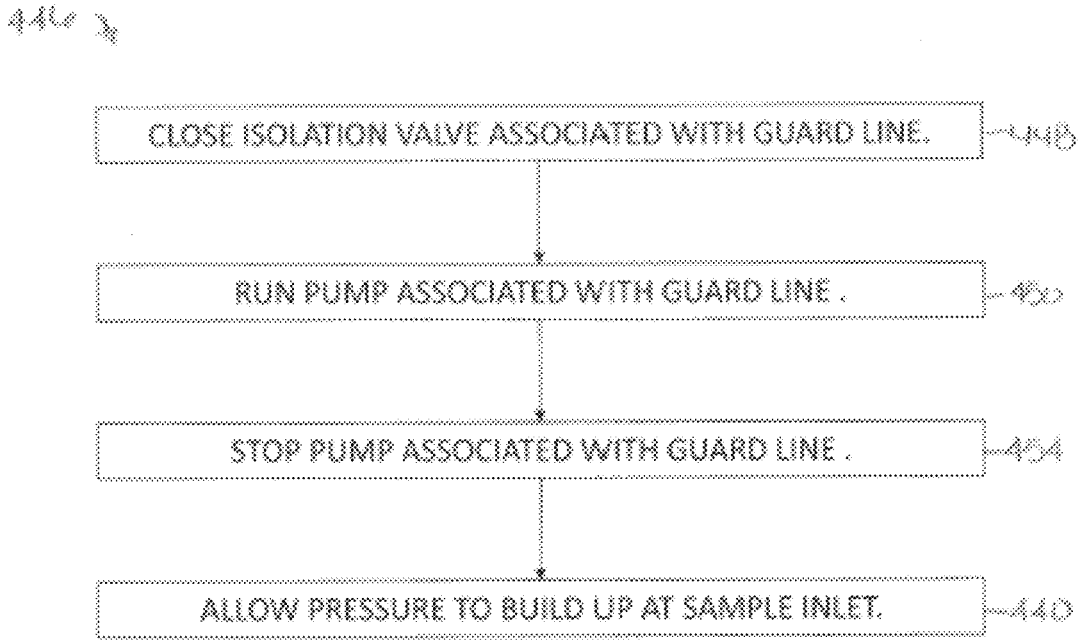
FIG. 30 illustrates a flowchart of a method for performing a sequenced pretest using the wireline wellsite system of FIGS. 23 and 24, whereby the fluid through the flowlines of the wireline wellsite system are comingled, in accordance with an embodiment.
Figure 31:
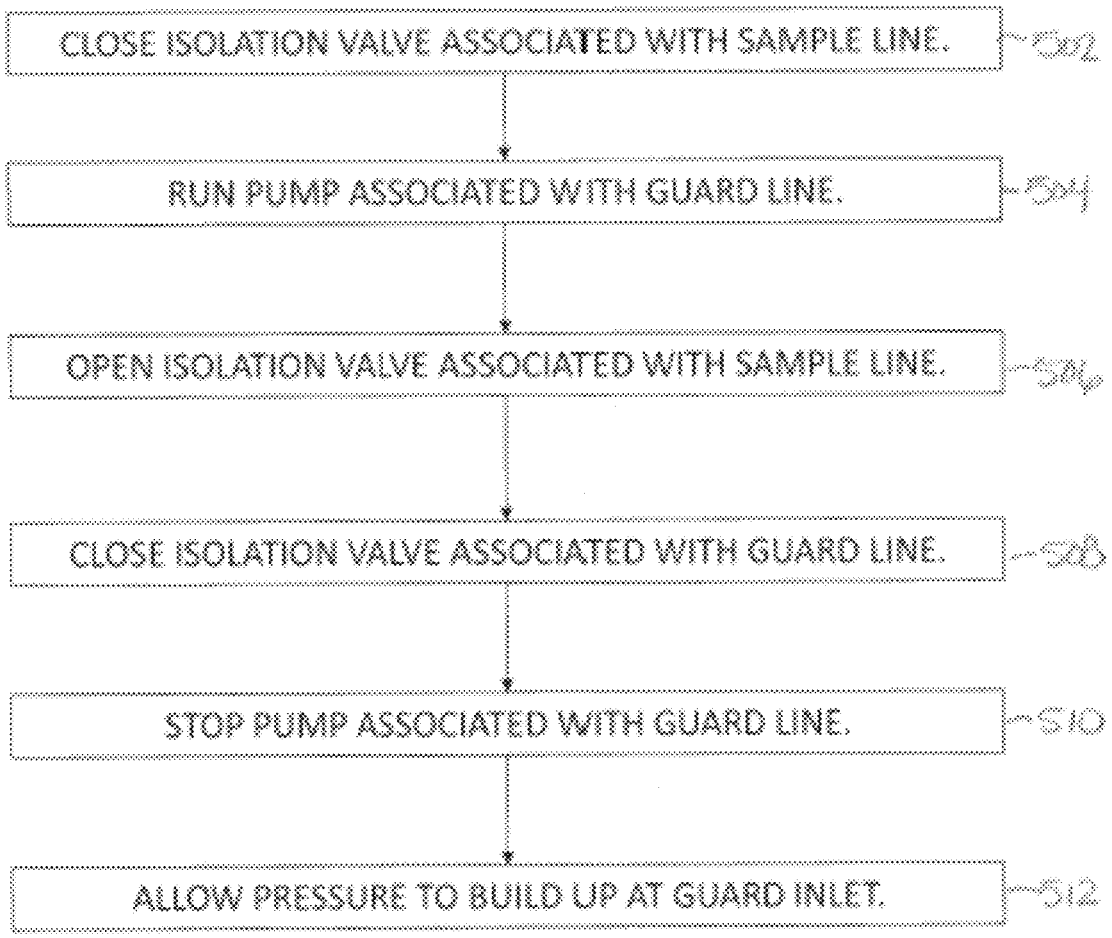
FIG. 31 illustrates a flowchart of a method of another example for performing a sequenced pretest using the wireline wellsite system of FIGS. 23 and 24, whereby the fluid through the flowlines of the wireline wellsite system are comingled, in accordance with an embodiment.
Figure 32:
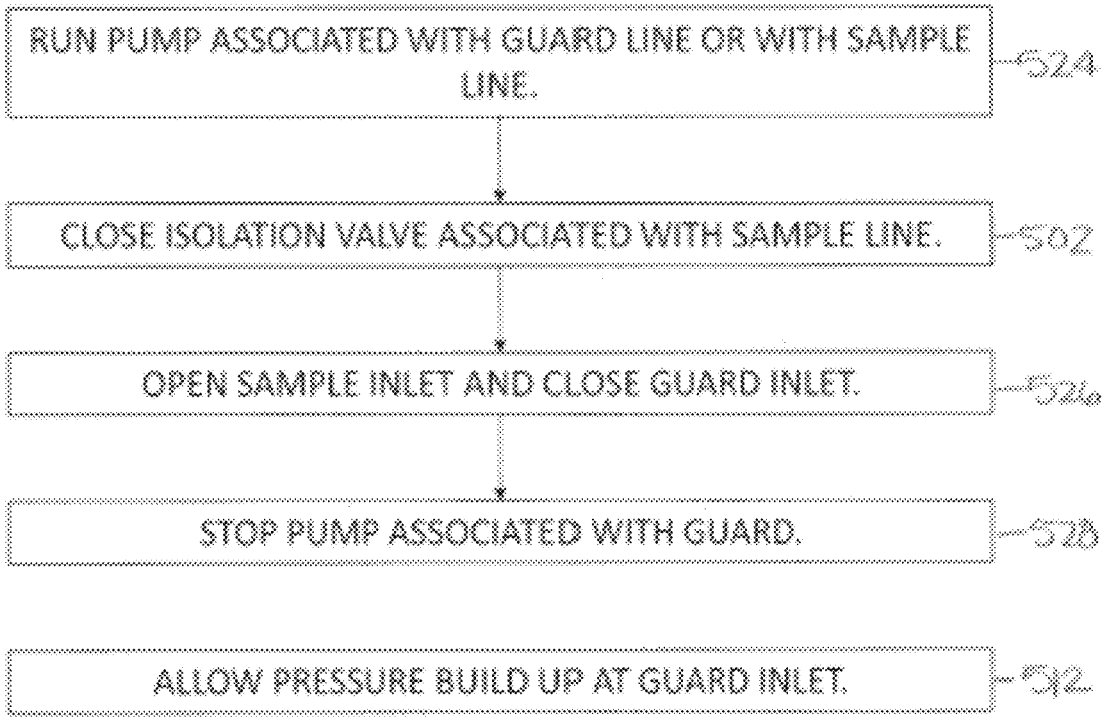
FIG. 32 illustrates a flowchart of a method of another example for performing a sequenced pretest using the wireline wellsite system of FIGS. 23 and 24, whereby the fluid through the flowlines of the wireline wellsite system are comingled, in accordance with an embodiment.
Figure 33:
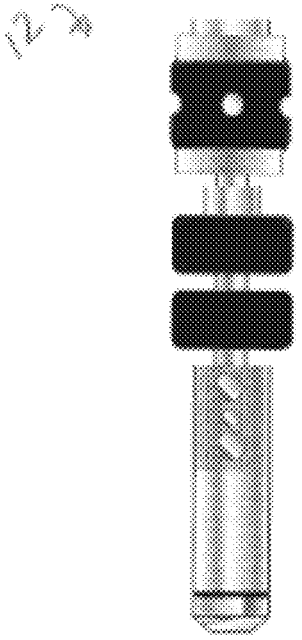
FIG. 33 illustrates a schematic diagram representing the wireline wellsite system of FIGS. 23 and 24 having multiple inlets for use in a sequence pretest method, in accordance with an embodiment.
Figure 34:
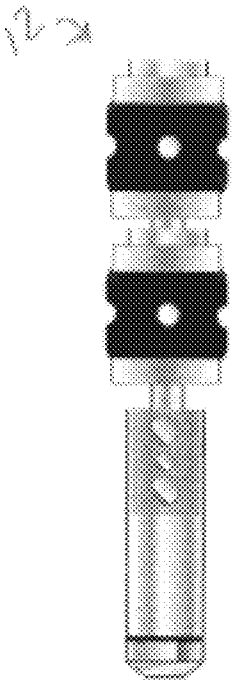
FIG. 34 illustrates a schematic diagram representing another example of the wireline wellsite system of FIGS. 23 and 24 having multiple inlets for use in a sequence pretest method, in accordance with an embodiment.
Figure 35:
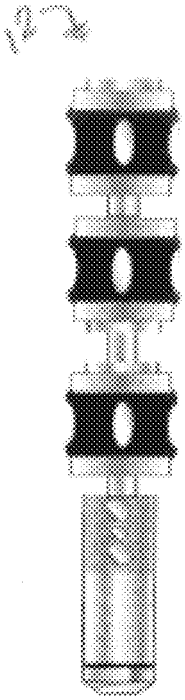
FIG. 35 illustrates a schematic diagram representing another example of the wireline wellsite system of FIGS. 23 and 24 having multiple inlets for use in a sequence pretest method, in accordance with an embodiment.

In sequenced pretests, the sample draw down may be taken sequentially before or after the guard draw down such that the following draw down (e.g., sample or guard line draw down) may be started immediately following the previous draw down (e.g., sample or guard line draw down) without waiting for the pressure to build up at the inlet (e.g., the sample and/or guard line inlet). FIGS. 30-32 illustrate sequenced pretest methods that may be used with the radial probe 400. Similar to the non-sequenced pretest methods illustrated in FIGS. 25-29, the sequenced pretest methods shown in FIGS. 30-32 start with all the valves (e.g., valves 416, 418, 420) being open. For example, FIG. 30 is flow diagram of a method 490 for performing a sequenced pretest, in accordance with an embodiment. The method 490 includes closing (block 448) the guard isolation valve 418. Following closing of the valves 418, the method 490 includes running (block 436) the sample line pump. In this particular embodiment, the guard line pump is not running, only the pump connected to the sample line. The method 490 also includes opening (block 492) the guard line isolation valve 418 and closing (block 494) the sample line isolation valve 416. The acts of blocks 492 and 494 may occur simultaneously, thereby allowing a transition from the sample line inlet draw down into the guard line inlet draw down. (The acts of blocks 492 and 494 may be reversed as well. For example, the sample isolation valve may be closed and the guard isolation valve can be opned.) The method 490 further includes stopping (block 496) the sample line pump and allowing (block 440) pressure to build up at the sample line inlet. In certain embodiments, the guard line isolation valve 418 may be closed as the guard line pump is stopped to allow pressure build up at the guard line inlet at the same time as the pressure build up in the sample line inlet.

In another embodiment, the guard line pump rather than the sample line pump may be run. For example, FIG. 31 illustrates another example of a flow diagram of method 500 for performing a sequenced pretest, in accordance with an embodiment. The method 500 includes closing (block 502) the sample isolation valve 416. Following closing of the sample line isolation valve 416, the method 500 includes running (block 504) the guard line pump. In this particular embodiment, the sample line pump is not running, only the pump connected to the guard line. The method 500 also includes opening (block 506) the sample line isolation valve 416 and closing (block 508) the guard line isolation valve 418. The acts of blocks 506 and 508 may occur simultaneously, thereby allowing a transition from the guard line inlet draw down into the sample line inlet draw down. (The acts of blocks 506 and 508 may be reversed as well. For example, the guard isolation valve may be closed and the sample isolation valve can be opned.) The method 500 further includes stopping (block 510) the guard line pump and allowing (block 512) pressure to build up at the guard line inlet. In certain embodiments, the sample line isolation valve 416 may be closed as the sample line pump is stopped to allow pressure build up at the sample line inlet at the same time as the pressure build up in the guard line inlet.

In certain embodiments, it may be desirable to compare pressure draw down from the sample, guard, and comingle flows (e.g., when analyzing the draw down for steady state mobility analysis). FIG. 32 illustrates a method 520 that may be used to compare pressure draw down from sample line flow, guard line flow, and comingle flow. In particular the method 520 may be used for a comingled pretest. The method 520 includes running (block 524) the sample line pump or the guard line pump. The method 520 also includes closing (block 502) the sample line isolation valve 416. In this way, the pretest transitions into the guard line pretest. Following closing of the sample line isolation valve 416, the method 520 includes opening (block 504) the sample line inlet and simultaneously closing (block 526) the guard line inlet. As such, the pretest transitions from the guard line pretest to the sample line pretest. The method 520 further includes stopping (block 528) the sample line or guard line pump, and allowing (block 512) pressure to build up at the guard line inlet. In certain embodiments, the sample line isolation valve 416 may also be closed as the sample line pump is stopped to allow pressure build up at the sample line inlet at the same time as the pressure build up in the guard line inlet. The sequence of comingled to guard line to sample line may easily be switched using the method 520.

The sequenced pretests described above with reference to FIGS. 30-32 may be run with downhole acquisition tool (e.g., the downhole acquisition tool 12) having multiple inlets. FIGS. 33-37 are schematic diagrams of a portion of the downhole acquisition tool 12 having multiple inlets that may be run together in sequenced pretests. When using downhole acquisition tools having multiple inlets, such as those shown in FIGS. 33-37, the sequenced pretest may facilitate completion of the pretest process in a desirable amount of time compared to processes that do not used the sequenced pretest methods. The inlets of the downhole acquisition tool 12 may be connected to the flowline through an interval valve, and at least one pump (e.g., the sample line pump and/or the guard line pump) is connected to at least one of the sample line 410 or the guard line 412. The interval valves associated with each inlet may be opened and closed without stopping the pumps such that the intervals may be opened to the pumps sequentially.

FIG. 38 is a flow diagram of a method 530 that may be used to run a sequenced pretest using any one of the multiple inlet downhole acquisition tools shown in FIGS. 33-37. The valves (e.g., sample isolation valve 416, guard isolation valve 418, and comingle valve 420) are opened at the start of the sequenced pretest. The method 530 includes running (block 532) the sample line pump or the guard line pump to draw down the obtained fluid 52 from a first interval (e.g., inlet of the downhole acquisition tool 12). The method 530 also includes closing (block 534) a first isolation valve associated with the first interval and opening (block 536) a second isolation valve associated with a second interval. The method 530 further includes stopping (block 540) the pump (e.g., the sample line pump or the guard line pump) and allowing (block 542) for the pressure to build up at the first interval. In this way, the pressure build up may begin at the first interval, while draw down of the obtained fluid 52 may begin at the second interval. The acts of block 534 and 536 may continue to allow sequential pressure build up and draw down from the respective intervals in the downhole acquisition tool 12. For example, if the downhole acquisition tool includes a third interval, the method 530 would include closing the second isolation valve associated with the second interval, and opening a third isolation valve associated with the third interval to allow pressure build up at the second interval and draw down from the third interval. In certain embodiments, the interval valve for the interval having the draw down may be closed as the pump is stopped to allow pressure build up in the respective interval. As such, the amount of time for completion of the sequenced pretest in downhole acquisition tools having multiple inlets (e.g., intervals) may be decreased compared to pretest process that are not sequenced.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method comprising:

positioning a downhole acquisition tool in a wellbore in a geological formation;

performing a pretest sequence to gather at least one of pressure or mobility information based on downhole acquisition from a sample line and a guard line while the downhole acquisition tool is within the wellbore, wherein the pretest sequence comprises:

controlling a valve assembly to a first valve configuration that enables a first fluid to flow into the downhole tool via a first flowline toward a pretest system, wherein the first flowline comprises the sample line, or the guard line;

drawing in the first fluid through the first flowline; and controlling the valve assembly to a second valve configuration, wherein the second valve configuration is different from the first valve configuration and is configured to block the first flowline from drawing in the first fluid and enable a second flowline to draw a second fluid toward the pretest system, wherein the second valve configuration is configured to enable an increase in pressure of the first fluid and the second fluid in the first flowline and the second flowline, respectively.

2. The method of claim 1, wherein drawing in the first fluid and the second fluid comprises using a pump to draw in the first fluid and the second fluid.

3. The method of claim 2, wherein the pump comprises a pre-test piston.

4. The method of claim 3, wherein a transition from the first valve configuration to the second valve configuration is configured to cause the pressure of the first fluid in the first fluid flowline to increase immediately, and wherein the second valve configuration is configured to cause the pressure of the second fluid in the second fluid flowline to increase based on a position of the pre-test piston.

5. The method of claim 1, comprising controlling the valve assembly to close isolation valves associated with the first flowline to block the flow of the first fluid into a first inlet of the pretest system coupled to the downhole acquisition tool; and controlling a pump associated with the second flowline to continue to draw in the second fluid through the second flowline, wherein isolation valves associated with the second flowline are open.

6. The method of claim 5, comprising controlling the valve assembly to close the isolation valves associated with the second flowline, and controlling the pump to block the flow of the second fluid through the second flow line and into a second inlet of the pretest system to allow pressure to build up at the second inlet.

7. The method of claim 5, comprising controlling the valve assembly to simultaneously close the isolation valves associated with the second flowline and open the isolation valves associated with the first flowline to transition from a second flowline draw of the second fluid to a first flowline draw of the first fluid.

8. The method of claim 7, comprising controlling the pump to block the flow of the second fluid through the second flowline and allow pressure to build up at the second inlet of the pretest system that is fluidly coupled to the second flowline.

9. The method of claim 1, comprising controlling a first pump associated with the sample line and a second pump associated with the guard line to draw in fluid through the sample and guard lines, respectively, wherein the sample line is fluidly coupled to a sample inlet of the pretest system and the guard line is fluidly coupled to a guard inlet of the pretest system and controlling the first pump, the second pump, or both, to stop drawing in the fluid, wherein the valve assembly is configured to close isolation valves associated with the sample line, the guard line, or both to allow pressure to build up at the sample inlet, the guard inlet, or both.

10. The method of claim 1, wherein the second valve configuration is configured to enable a simultaneous increase in pressure of the first fluid and the second fluid in the first flowline and the second flowline, respectively.

11. A system, comprising:

a downhole acquisition tool housing comprising a pretest system configured to collect at least one of pressure or mobility information that enters the downhole acquisition tool housing from a sample line and a guard line; and a data processing system configured to execute a pretest sequence by collecting fluid from the sample line and the guard line;

wherein the data processing system comprises one or more tangible, non-transitory, machine-readable media comprising instructions to perform a pretest sequence at least in part by:

controlling a valve assembly to a first valve configuration that enables a first fluid to flow into the downhole tool via a first flowline toward a pretest system, wherein the first flowline comprises the sample line or the guard line; and controlling the valve assembly to a second valve configuration, wherein the second valve configuration is different from the first valve configuration and is configured to block the first flowline from drawing in the first fluid and to enable a second flowline to draw a second fluid toward the pretest system, wherein the second valve configuration is configured to enable an increase in pressure of the first fluid and the second fluid in the first flowline and the second flowline, respectively.

12. The system of claim 11, wherein the downhole acquisition tool comprises one or more pumps configured to draw in the first fluid and the second fluid.

13. The system of claim 11, wherein the pretest sequence comprises performing a mobility analysis, a pressure analysis, or a combination thereof.

14. The system of claim 11, wherein controlling the valve assembly comprises closing isolation valves associated with the first flowline to block the flow of the first fluid into a first inlet of the pretest system coupled to the downhole acquisition tool; and controlling a pump associated with the second flowline to continue to draw in the second fluid through the second flowline, wherein isolation valves associated with the second flowline are open.

15. The system of claim 14, wherein controlling the valve assembly comprises to closing the isolation valves associated with the second flowline, and controlling the pump to block the flow of the second fluid through the second flow line and into a second inlet of the pretest system to allow pressure to build up at the second inlet.

16. The system of claim 14, wherein controlling the valve assembly comprises simultaneously closing the isolation valves associated with the second flowline and opening the isolation valves associated with the first flowline to transition from a second flowline draw of the fluid to a first flowline draw of the fluid.

17. The system of claim 16, wherein controlling the pump comprises blocking the flow of the second fluid through the second flowline and allowing pressure to build up at a second inlet of the pretest system that is fluidly coupled to the second flowline.

18. The system of claim 11, comprising controlling a first pump associated with the sample line and a second pump associated with the guard line to draw in fluid through the sample and guard lines, respectively, wherein the sample line is fluidly coupled to a sample inlet of the pretest system and the guard line is fluidly coupled to a guard inlet of the pretest system and controlling the first pump, the second pump, or both, to stop drawing in the fluid, wherein the valve assembly is configured to close isolation valves associated with the sample line, the guard line, or both to allow pressure to build up at the sample inlet, the guard inlet, or both.

19. The system of claim 11, wherein the second valve configuration is configured to enable a simultaneous increase in pressure of the first fluid and the second fluid in the first flowline and the second flowline, respectively.

20. The system of claim 11, wherein a transition from the first valve configuration to the second valve configuration is configured to cause the pressure of the first fluid in the first fluid flowline to increase immediately, and wherein the second valve configuration is configured to cause the pressure of the second fluid in the second fluid flowline to increase based on a position of a pre-test piston.

* * * * *